US007296877B2

(12) United States Patent
Chikuma et al.

(10) Patent No.: US 7,296,877 B2
(45) Date of Patent: Nov. 20, 2007

(54) INK JET PRINTING APPARATUS AND PRINT POSITION SETTING METHOD

(75) Inventors: Toshiyuki Chikuma, Kawasaki (JP); Hidehiko Kanda, Yokohama (JP); Aya Hayashi, Hachioji (JP)

(73) Assignee: Canon Kabushiki Kaisha, Tokyo (JP)

( * ) Notice: Subject to any disclaimer, the term of this patent is extended or adjusted under 35 U.S.C. 154(b) by 59 days.

(21) Appl. No.: 11/202,094

(22) Filed: Aug. 12, 2005

(65) Prior Publication Data

US 2006/0038842 A1 Feb. 23, 2006

(30) Foreign Application Priority Data

Aug. 18, 2004 (JP) ..... 2004-238866

(51) Int. Cl.
*B41J 2/15* (2006.01)

(52) U.S. Cl. ..... 347/41; 347/19

(58) Field of Classification Search ..... 347/19, 347/40, 41, 12, 13; 358/502, 1.2, 3.03, 1.9, 358/504

See application file for complete search history.

(56) References Cited

U.S. PATENT DOCUMENTS 4,723,129 A 2/1988 Endo et al.
4,740,796 A 4/1988 Endo et al.
6,164,745 A * 12/2000 Nagoshi et al. ..... 347/15
6,310,637 B1 * 10/2001 Shimada et al. ..... 347/19
6,532,026 B2 * 3/2003 Takahashi et al. ..... 347/41
2003/0197755 A1 * 10/2003 Murakami ..... 347/40
2004/0165033 A1 * 8/2004 Chikuma et al. ..... 347/41
2004/0207675 A1 * 10/2004 Otsuki ..... 347/19
2005/0219280 A1 * 10/2005 Hiwada et al. ..... 347/5

FOREIGN PATENT DOCUMENTS

JP 61-222778 10/1986
JP 4-41252 2/1992

* cited by examiner

*Primary Examiner*—Matthew Lulu
*Assistant Examiner*—Joshua M Dubnow
(74) *Attorney, Agent, or Firm*—Fitzpatrick, Cella, Harper & Scinto

(57) ABSTRACT

An ink jet printing apparatus and a print position adjusting method capable of easily adjusting a relative print position between nozzle lines are provided. Images are printed on a print medium in a drive mode A and a drive mode B by using a print head which has first and second nozzle groups, each including a plurality of ink ejection nozzle lines. In the drive mode A, only one of the first and second nozzle groups is driven during one scan of the print head. In the drive mode B, the first and second nozzle groups are driven at different timings during one scan of the print head. A print position adjust value for adjusting a relative print position between the nozzle lines in the drive mode A is retrieved. Depending on whether the print position adjust value is even or odd, a print position correction value for the first nozzle group and a print position correction value for the second nozzle group are determined.

11 Claims, 19 Drawing Sheets

+1

CORRECTION PROCESS ON FIRST NOZZLE GROUP

INK JET PRINTING APPARATUS AND PRINT POSITION SETTING METHOD

BACKGROUND OF THE INVENTION

1. Field of the Invention

The present invention relates to an ink jet printing apparatus and a print position setting method capable of adjusting a relative print position between nozzle lines.

This invention is applicable to a wide range of equipment using a variety of print mediums such as paper, cloth, leather, nonwoven fabric, OHP sheets, and even metal. Among applicable equipment are office equipment, including printers, copying machines and facsimiles, and industrial manufacturing equipment.

2. Description of the Related Art

As an information output device in word processors, personal computers and facsimiles, printers (printing apparatus) that print information such as characters and images on sheet-like print mediums such as paper and films are in wide use.

A variety of printing systems are known. An ink jet system in particular, which ejects ink from a printing means (print head) onto a print medium, has come into widespread use because of its advantages, which include an ease with which the printing system size can be reduced, an ability to print a high-resolution image at high speed, a low running cost, low noise achieved by non-impact system, and an ease with which a color image can be printed by using multiple color inks.

In a printing apparatus of an ink jet system (hereinafter referred to as an "ink jet printing apparatus"), a print head (ink jet print head) may be used which has a plurality of lines of ink ejection nozzles. In such a print head, nozzle lines may have subtle variations in their positioning accuracy and there may also occur differences in ink ejection speed among different nozzle lines. Let us consider a case where such a print head is used on an ink jet printing apparatus of a serial scan type. If ink is ejected from the different nozzle lines onto a print medium at the same drive timing while the print head is moved in a main scan direction, ink landing positions on the print medium may deviate between the nozzle lines. This results in subtle deviations in relative print position between the different nozzle lines. If printing is performed with the relative print position deviated among the different nozzle lines, printed lines may fail to align or a density of dots formed on the print medium may vary depending on locations and ink colors, giving the printed image a granular impression.

Therefore, the relative print position between the nozzle lines needs to be adjusted (generally called "print position adjustment") to improve the quality of printed images.

Such a print position adjustment is made as follows. First, nozzle lines are used to print on a print medium a plurality of print position adjustment patterns by differentiating their printing conditions. Then, from among the printed patterns a most desirable pattern is chosen and, based on the printing condition of the selected pattern, an inter-nozzle line printing condition is set. More specifically, two nozzle lines whose relative print position is to be adjusted are driven at such drive timings as will shift their relative print position progressively in a main scan direction to print a plurality of print position adjustment patterns on a print medium. From among the printed patterns, an optimum pattern is selected and, based on the drive timing used to print that pattern, the print position adjustment is made.

In an ink jet printing apparatus having a plurality of nozzle lines, as described above, the adjustment of relative print position between the nozzle lines can improve a quality of printed image.

A technique has been known which prints print position adjustment patterns by using a plurality of nozzle lines and, based on the printed result, performs a print position adjustment for each nozzle line. Japanese Patent Disclosure No. 61-222778, for example, discloses a method which causes each of multiple color head units to print a predetermined pattern to check for a presence or absence of a deviation between the head units. Japanese Patent Disclosure No. 04-041252 discloses a method which reads a predetermined pattern printed by each of a plurality of nozzle lines to automatically check for any positional deviation.

In recent years, for an improved quality of printed images, new printing techniques have come to be used, which include using many nozzle lines to eject various kinds of inks or multimode nozzle lines with different ink ejection amounts. Under these circumstances, there is a tendency for an increase in the number of equipped nozzle lines.

When the print position adjustment pattern is printed using each of the increasing number of nozzle lines, the number of patterns printed naturally increases and an amount of ink consumed in the pattern printing also increases. Further, this technique requires an additional process of selecting the best printed result from among many printed patterns. If this selection process is left to the user, this becomes an onerous burden for the user. This technique also requires calculating adjust values of print positions associated with the large number of nozzle lines, based on the printed result of these patterns, and setting again the drive timings of individual nozzle lines. This process also represents a large burden.

SUMMARY OF THE INVENTION

This invention can provide an ink jet printing apparatus and a print position adjusting method capable of easily adjusting a relative print position between nozzle lines.

In the first aspect of the present invention, there is provided an ink jet printing apparatus for printing an image on a print medium by using a print head having a first nozzle group including a plurality of first nozzle lines capable of ejecting ink and a second nozzle group including a plurality of second nozzle lines capable of ejecting ink, wherein the image is formed in a first drive mode and a second drive mode, the first drive mode driving only one of the first and second nozzle group during one scan of the print head, the second drive mode driving the first and second nozzle group at different timings during one scan of the print head; the ink jet printing apparatus comprising:

adjust value retrieving means for retrieving a first drive mode adjust value, the first drive mode adjust value being used to adjust a relative print position between the first nozzle lines in the first drive mode; and adjust value setting means for setting a second drive mode adjust value based on the first drive mode adjust value, the second drive mode adjust value being used to adjust a relative print position between the first nozzle lines and between the second nozzle lines in the second drive mode.

In the second aspect of the present invention, there is provided a print position setting method used in a process of forming an image on a print medium by using a print head having a first nozzle group including a plurality of first nozzle lines capable of ejecting ink and a second nozzle group including a plurality of second nozzle lines capable of ejecting ink, wherein the image is formed in a first drive mode and a second drive mode, the first drive mode driving only one of the first and second nozzle group during one scan of the print head, the second drive mode driving the first and second nozzle group at different timings during one scan of the print head; the print position setting method comprising the steps of:

retrieving a first drive mode adjust value, the first drive mode adjust value being used to adjust a relative print position between the first nozzle lines in the first drive mode; and adjusting, based on the first drive mode adjust value, a relative print position between the first nozzle lines and between the second nozzle lines in the second drive mode.

In this invention, images are printed on a print medium in a first drive mode and a second drive mode by using a print head which has a first nozzle group including a plurality of first ink ejection nozzle lines and a second nozzle group including a plurality of second ink ejection nozzle lines. The first drive mode is a drive mode to drive only one of the first and second nozzle groups during one scan of the print head. The second drive mode is a drive mode to drive the first and second nozzle group at different timings during one scan of the print head.

With this invention, a first drive mode adjust value is retrieved for adjusting a relative print position between the first nozzle lines in the first drive mode. Based on the first drive mode adjust value, a relative print position between the first nozzle lines and between the second nozzle lines in the second drive mode is adjusted. As a result, the relative print position between the nozzle lines in the second drive mode can be adjusted easily, which in turn reduces the number of print position adjust patterns required to be printed.

The above and other objects, effects, features and advantages of the present invention will become more apparent from the following description of embodiments there of taken in conjunction with the accompanying drawings.

DETAILED DESCRIPTION OF PREFERRED EMBODIMENTS

Now, referring to the accompanying drawings, preferred embodiments of this invention will be described in detail. In the following description, a printing apparatus using an ink jet printing system is taken up as an example.

In this specification, a word "print" signifies not only forming significant information such as characters and figures but also generally forming images, patterns or the like on a variety of print mediums, whether they are significant or nonsignificant or whether or not they are visible so that they can be perceived by human sight. The word "print" also include processing of print mediums.

A word "print medium" signifies not only paper commonly used in printing apparatus but also any kind of materials that can receive ink, such as cloth, plastic films, metal sheets, glass, ceramics, wood and leather.

Further, a word "ink" should be construed broadly as in the case of "print (record)" and refers to a liquid used to form images, patterns or the like by being applied to a print medium or to process the print medium and ink (e.g., to coagulate or insolubilize a colorant in ink applied to the print medium).

First Embodiment

In the following, the first embodiment of this invention will be described in three separate categories: a construction of a printing apparatus, a construction of a control system, and an adjustment of a print position.

[Construction of Printing Apparatus]

Figure 1:
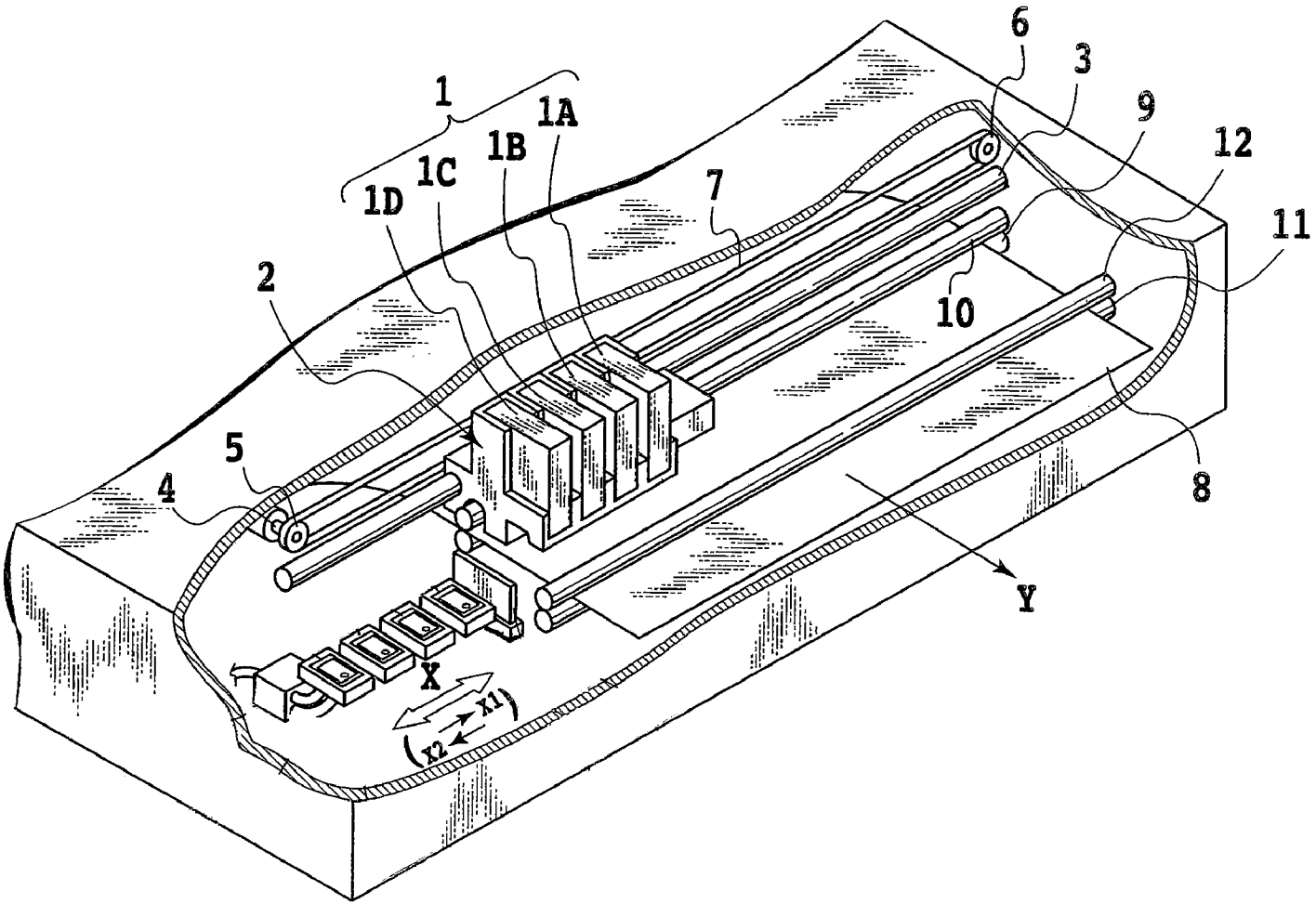
FIG. 1 is a schematic perspective view showing an essential portion of an ink jet printing apparatus that can apply the present invention.

FIG. 1 is a perspective view schematically showing an essential construction of an ink jet printing apparatus of this invention. In FIG. 1, a head cartridge 1 as a printing means is removably mounted on a carriage 2. This head cartridge 1 includes four head cartridges 1A, 1B, 1C, 1D using different kinds of inks (e.g., different colors). Each of the head cartridges 1A, 1B, 1C, 1D includes a print head formed with a plurality of nozzles for ejecting ink and an ink tank for supplying ink to the print head.

The cartridges 1A-1D are each provided with a connector to receive a drive signal for the print head. In the following description, all of the cartridges 1A-1D or any one of them are designated simply by a printing means (print head or head cartridge) 1.

To allow for color printing using different color inks, the ink tanks of the head cartridge 1 accommodate different inks such as black (B), cyan (C), yellow (Y) and magenta (M)

inks. In this example, the print heads in the head cartridges 1A, 1B, 1C, 1D eject the black (B), cyan (C), yellow (Y) and magenta (M) inks, respectively, which are supplied from the associated ink tanks. The head cartridge 1 is positioned and removably mounted on the carriage 2. The carriage 2 is provided with a connector holder (electric connecting portion) to transmit drive signals through associated connectors to the cartridges 1A-1D.

The carriage 2 is guided along a guide shaft 3 installed in the apparatus body so that it can be moved in a main scan direction indicated by an arrow X. This carriage 2 is driven and controlled by a carrier motor 4 through a motor pulley 5, a follower pulley 6 and a timing belt 7. A print medium 8, such as paper and plastic thin sheet, is fed in a subscan direction indicated by an arrow Y by two sets of transport roller pairs 9, 10 and 11, 12 rotated by a transport motor (not shown) so that the print medium passes through a position (printing portion) opposing a face (ejection port forming face) of the print head 1 on which ejection ports are formed. The print medium 8 is supported at its back on a platen (not shown) so that it forms a planar print surface in the printing portion. The ejection port forming face of each cartridge 1A-1D mounted on the carriage 2 protrudes down from the carriage 2 to parallelly oppose the print surface of the print medium 8 supported between the two sets of transport roller pairs 9, 10 and 11, 12.

The print head 1 is an ink jet printing means which ejects ink from its ejection ports by using various ejection systems based on electrothermal transducers (heaters) or piezoelectric elements. In the case of electrothermal transducers, a thermal energy generated by each electrothermal transducer forms a bubble in ink which in turn expels ink from each ejection port by a pressure change generated as it grows and contracts.

Figure 2:
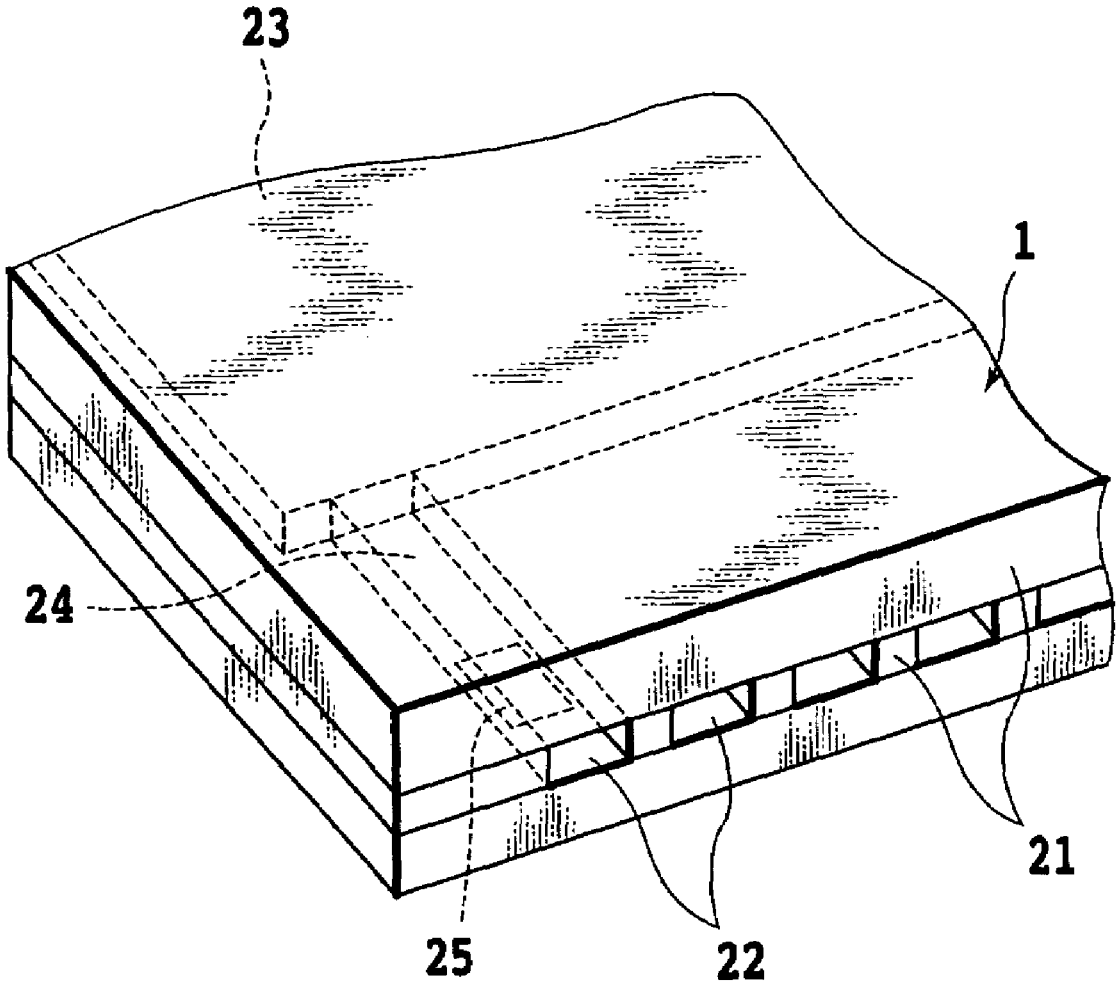
FIG. 2 is a schematic perspective view showing an essential portion of an ink ejection portion of a print head used in the printing apparatus of FIG. 1.

FIG. 2 is a schematic perspective view showing an essential portion of an ink ejection portion in the print head 1. The ink ejection portion of this example uses electrothermal transducers for ejecting ink.

In FIG. 2, the ejection port forming face (surface of the print head formed with ejection ports) 21, which opposes the print medium 8 with a predetermined distance (about 0.5-2 [mm]) in between, is formed with a plurality of ejection ports 22 at a predetermined pitch. A wall of each path 24 connecting a common ink chamber 23 to each ejection port 22 is provided with an electrothermal transducer (such as heating resistor) 25 to generate ink ejection energy. The print head 1 is mounted on the carriage 2 so that the ejection ports 22 are arrayed in a direction crossing the scan direction of the carriage 2. Then, based on a print signal or ejection signal, the corresponding electrothermal transducer 25 is energized to cause a film boiling in ink in each path 24 to eject ink from the ejection port 22 by the pressure generated.

[Construction of Control System]

Figure 3:
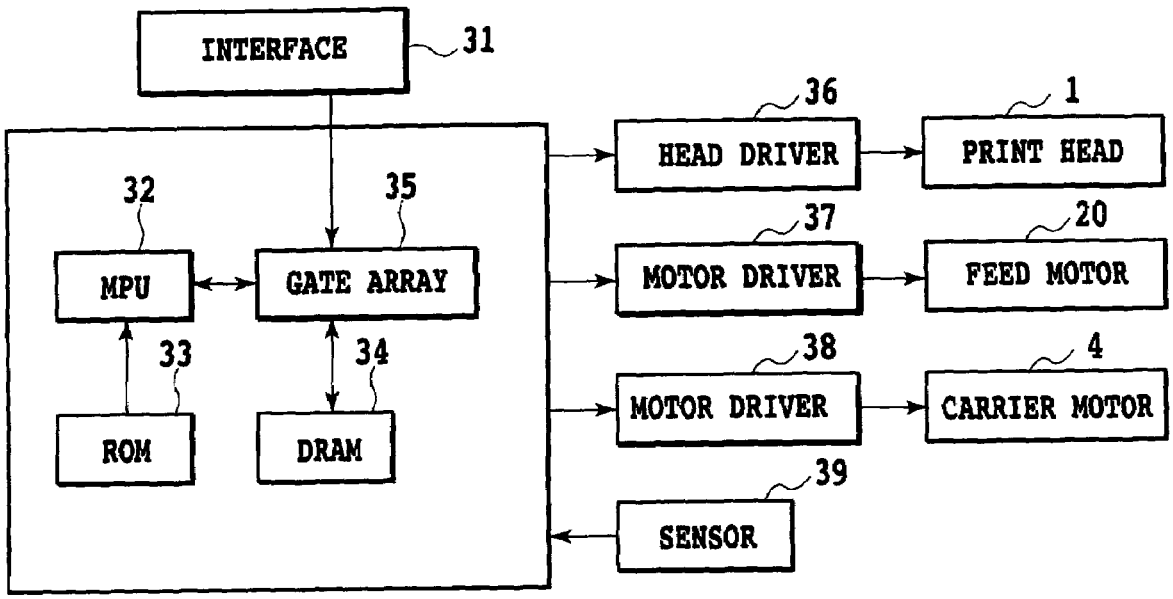
FIG. 3 is a block configuration diagram of a control system in the printing apparatus of FIG. 1.

FIG. 3 is a block diagram showing a configuration of a control system in the ink jet printing apparatus of FIG. 1.

In FIG. 3, designated 31 is an interface through which a print signal is input from a host device such as computer not shown; and 32 is a microprocessor unit (MPU). Reference number 33 represents a program ROM to store a control program to be executed by the MPU 32. A DRAM 34 stores various data, including a print signal and print data to be supplied to the print head 1. The DRAM 34 can also store (count) the number of dots to be printed and a printing time. A gate array 35 controls the supply of print data to the print head 1 and also controls data transfer between the interface 31 and the MPU 32 and DRAM 34.

Denoted 4 is a carrier motor (main scan motor) to transport the carriage 2 carrying the print head 1; and 20 is a feed motor to feed the print medium 8 such as print paper. Designated 36 is a head driver to drive the print head 1; 37 a motor driver to drive the feed motor 20; and 38 a motor driver to drive the carrier motor 4. Denoted 39 is a group of sensors to perform various detections. Sensors 39 may include, for example, a sensor to detect the presence or absence of the print medium 8, a sensor to detect when the carriage 2 is at a home position, and a sensor to detect a temperature of the print head 1. By using these sensors, the presence or absence of the print medium 8, the moving position of the carriage 2, and the ambient temperature can be determined.

When print data is sent from a host device to the printing apparatus through the interface 31, it is temporarily stored in the DRAM 34. Then, the data in the DRAM 34 is converted by the gate array 35 from raster data into image data to be printed by the print head 1 and again stored in the DRAM 34. The gate array 35 then sends the converted data to the print head 1 through the head driver 36 to cause the ejection port at a position corresponding to the data to eject ink, thus forming dots on the print medium 8. By building a counter in the gate array 35, it is possible to count at high speed the number of dots to be formed.

The carrier motor 4 is energized through the motor driver 38 to move the carriage 2 in the main scan direction in accordance with the printing speed of the print head 1, thereby completing one printing scan. After this main scan printing operation, the feed motor 20 is driven through the motor driver 37 to transport the print medium 8 a predetermined distance or pitch in a subscan direction that crosses the main scan direction. Then, for the next main scan printing, the carrier motor 4 is driven through the motor driver 38 to move the carriage 2 in the main scan direction at a speed that matches the printing speed of the print head 1. After the main scan printing is completed, the print medium 8 is fed in the subscan direction again. This series of operations is repeated to form an image over an entire area of the print medium 8.

[Print Position Adjustment]

In this example, the print head has at least a first nozzle group used to print dots (print element) of a first size and a second nozzle group used to print dots of a second size. There are two print modes: a print mode A that uses only one of the first nozzle group and the second nozzle group; and a print mode B that drives the first nozzle group and the second nozzle group at different timings. Based on a print position adjust value for adjusting a relative print position between a plurality of nozzle lines in the print mode A, a print position adjust value for adjusting a relative print position between a plurality of nozzle lines in the print mode B is determined.

Figure 4:
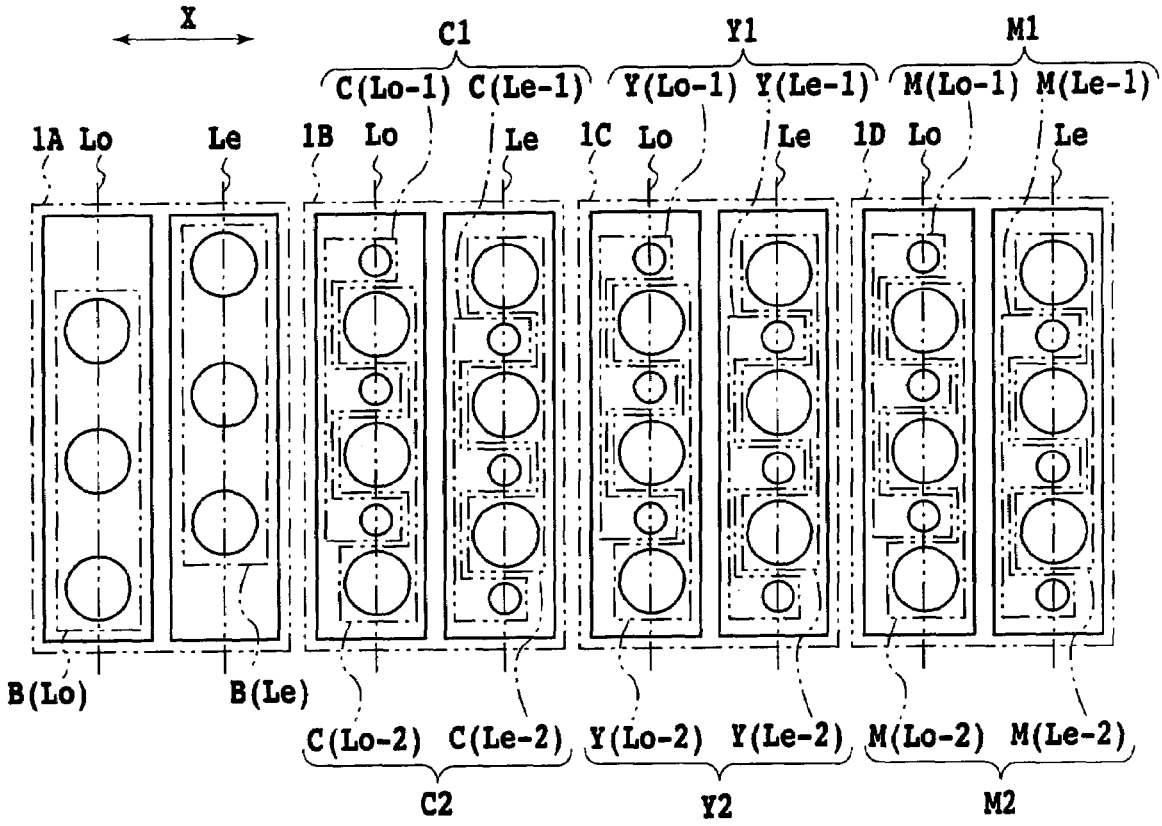
FIG. 4 is an explanatory diagram showing a nozzle arrangement in the print head in a first embodiment of the invention.

FIG. 4 is an explanatory diagram showing a construction of the head cartridge 1 in this example.

Each of the head cartridges 1A, 1B, 1C, 1D is formed with two nozzle lines (Lo, Le) each having a plurality of nozzles arrayed in a line. The nozzle line Lo is also called an odd-numbered nozzle line and the nozzle line Le an even-numbered nozzle line. The head cartridge 1A for black (B) ink is formed with ejection ports that eject a large volume of ink to form a large dot and which are arranged in two nozzle lines Lo, Le in a staggered manner. The ejection ports in the odd-numbered nozzle line Lo form a large nozzle group in odd-numbered line for ejecting black ink (black odd-numbered line large nozzle group) B(Lo). The election ports in the even-numbered nozzle line Le form a large nozzle group in even-numbered line for ejecting black ink (black even-numbered line large nozzle group) B(Le).

Each of the head cartridges 1B, 1C, 1D for cyan (C), magenta (M) and yellow (Y) inks (these inks are also referred to as "color inks") has formed in the nozzle lines Lo, Le ejection ports that eject a large volume of ink to form a large dot (also called "large ejection ports") and ejection ports that eject a small volume of ink to form a small dot (also called "small ejection ports").

In the head cartridge 1B for cyan ink, each of the nozzle lines Lo, Le is formed with small ejection ports and large ejection ports alternately. On these nozzle lines Lo, Le, small ejection ports are formed in a staggered manner and large ejection ports are also formed in a staggered manner. In the head cartridge 1B, the small ejection ports on the nozzle line Lo form small nozzles in odd-numbered column for ejecting cyan ink (cyan odd-numbered line small nozzles) C(Lo-1). The large ejection ports on the nozzle line Lo form large nozzles in odd-numbered line for ejecting cyan ink (cyan odd-numbered line large nozzles) C(Lo-2). The small ejection ports on the nozzle line Le form small nozzles in even-numbered line for ejecting cyan ink (cyan even-numbered line small nozzles) C(Le-1). The large ejection ports on the nozzle line Le form large nozzles in even-numbered line for ejecting cyan ink (cyan even-numbered line large nozzles) C(Le-2). The cyan odd-numbered line small nozzles C(Lo-1) and the cyan even-numbered line small nozzles C(Le-1) together constitute a small-nozzle group (first nozzle group) C1; and the cyan odd-numbered line large nozzles C(Lo-2) and the cyan even-numbered line large nozzles C(Le-2) together constitute a large-nozzle group (second nozzle group) Co.

Similarly, in the head cartridge 1C for yellow ink, Y(Lo-1), Y(Lo-2), Y(Le-1) and Y(Le-2) are yellow odd-numbered line small nozzles, yellow odd numbered line large nozzles, yellow even-numbered line small nozzles and yellow even-numbered line large nozzles, respectively. Y1 represents a yellow small-nozzle group (first nozzle group) and Y2 represents a yellow large-nozzle group (second nozzle group). Similarly, in the head cartridge 1D for magenta ink, M(Lo-1), M(Lo-2), M(Le-1) and M(Le-2) are magenta odd-numbered line small nozzles, magenta odd numbered line large nozzles, magenta even-numbered line small nozzles and magenta even-numbered line large nozzles, respectively. Further, M1 represents a magenta small-nozzle group (first nozzle group) and M2 represents a magenta large-nozzle group (second nozzle group).

As described above, for each color ink (cyan, magenta, yellow) the head cartridge 1B, 1C, 1D includes two nozzle groups: a small-nozzle group C1, M1, Y1 used to eject a small volume of ink to form a small dot (first nozzle group to print dots (print elements) of first size); and a large-nozzle group C2, M2, Y2 used to eject a large volume of ink to form a large dot (second nozzle group to print dots (print elements) of second size). Each of the head cartridges 1B, 1C, 1D has two nozzle lines Lo, Le in which these small nozzles and large nozzles are arranged alternately. In these two nozzle lines Lo, Le, the positions of the large nozzles are staggered in the vertical direction as shown in FIG. 4. Likewise, the positions of the small nozzles in the two nozzle lines Lo, Le are also staggered.

In the head cartridge for each color ink, the small nozzles (Lo-1) and the large nozzles (Lo-2) in the odd-numbered line Lo cannot be driven at the same timings during the same printing scan for a reason associated with a drive circuit and they are energized at staggered timings. Similarly, the small nozzles (Le-1) and the large nozzles (Le-2) in the even-numbered line Le cannot be driven at the same timings during the same printing scan for a reason associated with a drive circuit and they are energized at staggered timings.

Further, in the head cartridge for each color ink, the nozzles Lo-1, Le-1 belonging to the first nozzle group can be driven in a way that forms dots at the same column positions during the same printing scan (this is also called "simultaneous driving"). At this time, a relative print position between the nozzle lines (dot formation positions) can be adjusted as explained later. Similarly, the nozzles Lo-2, Le-2 belonging to the second nozzle group can be driven in a way that forms dots at the same column positions during the same printing scan (this is also called "simultaneous driving"). At this time, a relative print position between the nozzle limes (dot formation positions) can also be adjusted as explained later. In the construction of this embodiment, the first nozzle group and the second nozzle group cannot be driven simultaneously to form dots at the same column positions during the same printing scan.

The print mode using such a print head may be set in one of two drive modes A, B. The drive mode A is a print mode in which printing is done by using only one of the first and second nozzle group during at least one printing scan. The drive mode B is a print mode in which printing is done by alternately activating the first and second nozzle group along the successive columns during at least one printing scan.

Figure 5:
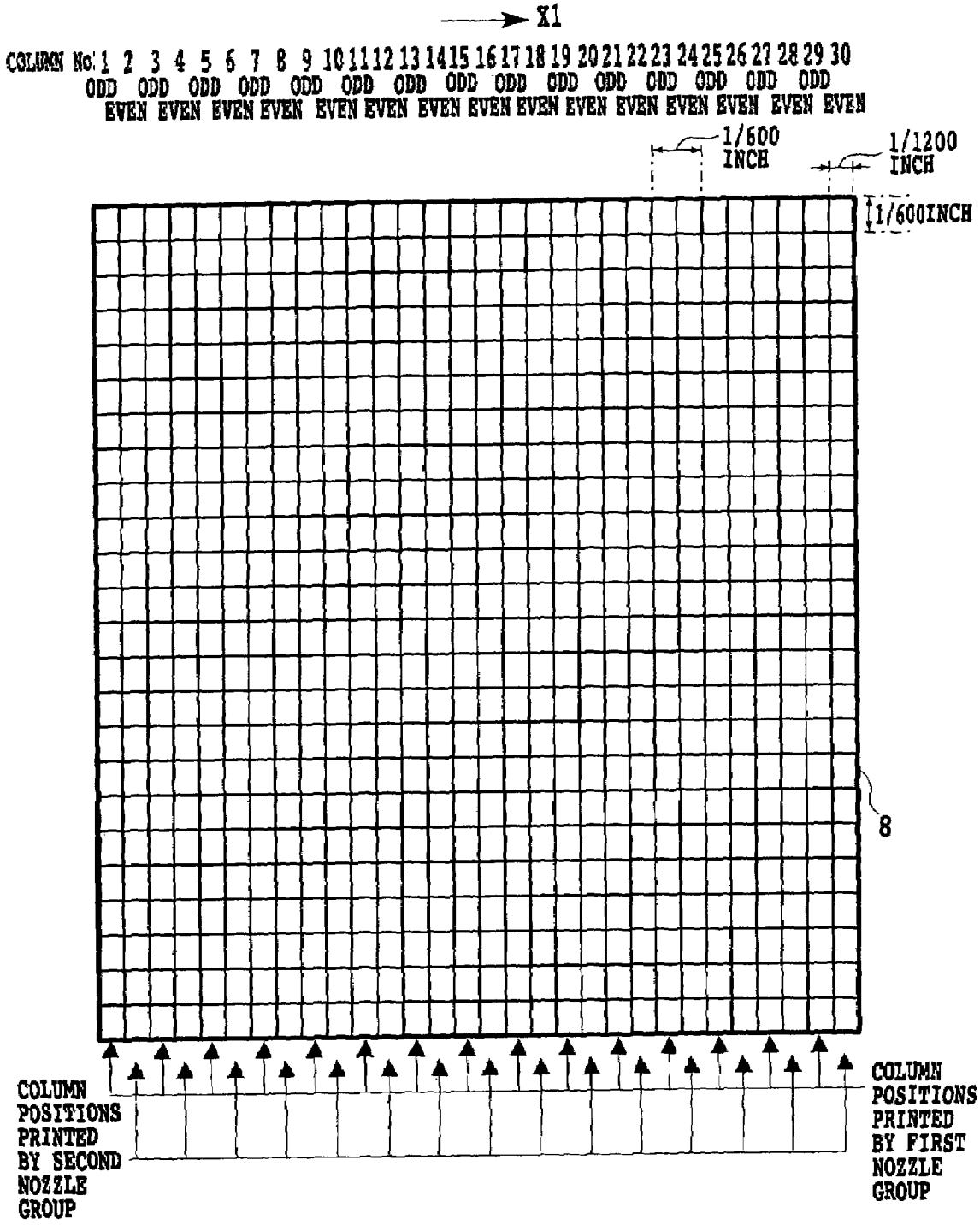
FIG. 5 is an explanatory diagram showing a relation between nozzle groups and print columns in the first embodiment of the invention.

For example, as shown in FIG. 5, in the drive mode B the first and second nozzle group can be alternately activated along odd- and even-numbered lines to perform a multipass printing. The multipass printing is a printing method that completes the printing operation over a particular print area by scanning the print head multiple times. In FIG. 5, columns are defined to be positioned at intervals of 1/1200 inch in the main scan direction. As the print head is scanned in the direction of arrow X1 for printing on the print medium 8, the nozzle group to be used is alternated between the first and second nozzle group along the individual columns arranged in the main scan direction. That is, printing is done by alternately activating the first and second nozzle group so that the first nozzle group is activated on the odd-numbered columns and the second nozzle group on the even-numbered columns. The interval of the nozzle drive timings, as shown in FIG. 5, is such that the dots formed by the first nozzle group and the dots formed by the second nozzle group are spaced a distance of 1200 dpi. When only the first nozzle group or second nozzle group is used, the dots are formed at intervals of 600 dpi.

In this drive mode B, the first nozzle group that ejects a small volume of ink may be used over a highlighted portion of an image being printed, thus reducing graininess. Over a dark portion of the image the second nozzle group that ejects a large volume of ink may be used to represent high densities while at the same time reducing the number of ejections. As a result, the printed quality can be improved without reducing the printing speed. Further, by controlling the nozzle operation so that different nozzle groups are not activated simultaneously, print data for each column to be supplied to the print head can be divided into the nozzle groups. Further, different nozzle groups may share print data transfer signal lines. The drive mode B therefore can reduce the cost of the print head and the printing apparatus.

The black (B) ink head cartridge 1A is formed with only large nozzles that eject the same volumes of ink and is driven by a method different from those of the color ink head cartridges 1B, 1C, 1D. In the following, our explanation concerns specifically color ink head cartridges, omitting the black (B) ink head cartridge 1A from the explanation.

In this example, the print position adjust patterns are printed in the drive mode A to adjust the relative print position between different nozzle lines. Two or more of the adjust patterns are printed by progressively shifting the drive timings of two nozzle lines to be adjusted. Then, from among the printed patterns, a best printed result is chosen and, based on the drive timing used for that selected pattern, the drive timings of the two nozzle lines are adjusted.

The print position adjust patterns can be printed in a single printing scan or multiple printing scans in the drive mode A. That is, if the two nozzle lines being adjusted are small-nozzle lines, the print position adjust patterns can be printed in one printing scan by ejecting ink from these nozzles. It is of course possible to print the print position adjust patterns by ejecting ink from one small-nozzle line during the first printing scan and, during the second printing scan, ejecting ink from the other small-nozzle line. This also applies where the two nozzle lines being adjusted are both large-nozzle lines.

The print position adjust patterns printed by small-nozzle line and the print position adjust patterns printed by large-nozzle line may exist in combination. In this case, the former pattern may be printed by the first printing scan in the forward direction and the latter pattern by the second printing scan in the backward direction. Between the first and second printing scan, the print medium 8 does not need to be fed. When two nozzle lines to be adjusted are a small-nozzle line and a large-nozzle line, the print position adjust patterns may be printed by ejecting ink from the small-nozzle line during the first printing scan in the forward direction and then, with the print medium left unfed, ejecting ink from the large-nozzle line during the second printing scan in the backward direction.

As described above, in the print mode A in which the printing scan using the first nozzle group and the printing scan using the second nozzle group can be separated, the print position adjust patterns can be printed in a plurality of printing scans. Therefore, the ink ejection timing for the first nozzle group and the ink ejection timing for the second nozzle group can be set arbitrarily without being restricted by each other.

Figure 6:
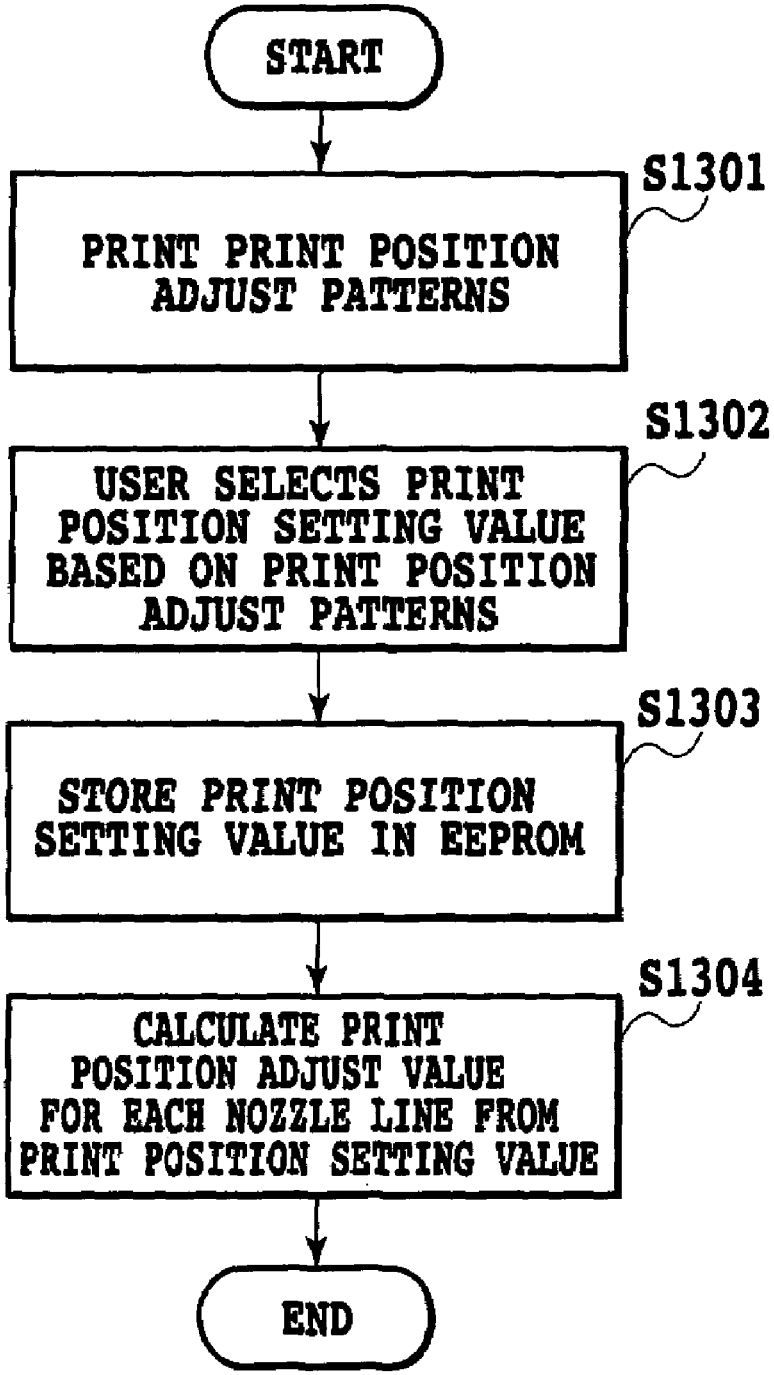
FIG. 6 is a flow chart showing a procedure for calculating a print position adjust value in the first embodiment of the invention.

FIG. 6 is a flow chart showing a method of calculating a print position adjust value by using the above-described print position adjust patterns. The print position adjust patterns are specific test patterns that allows for easy detection of any deviation of the relative print position between the two nozzle lines on the print medium (generally paper) 8. A part or combinations of the test patterns are generally called print position adjust patterns.

Figure 7:
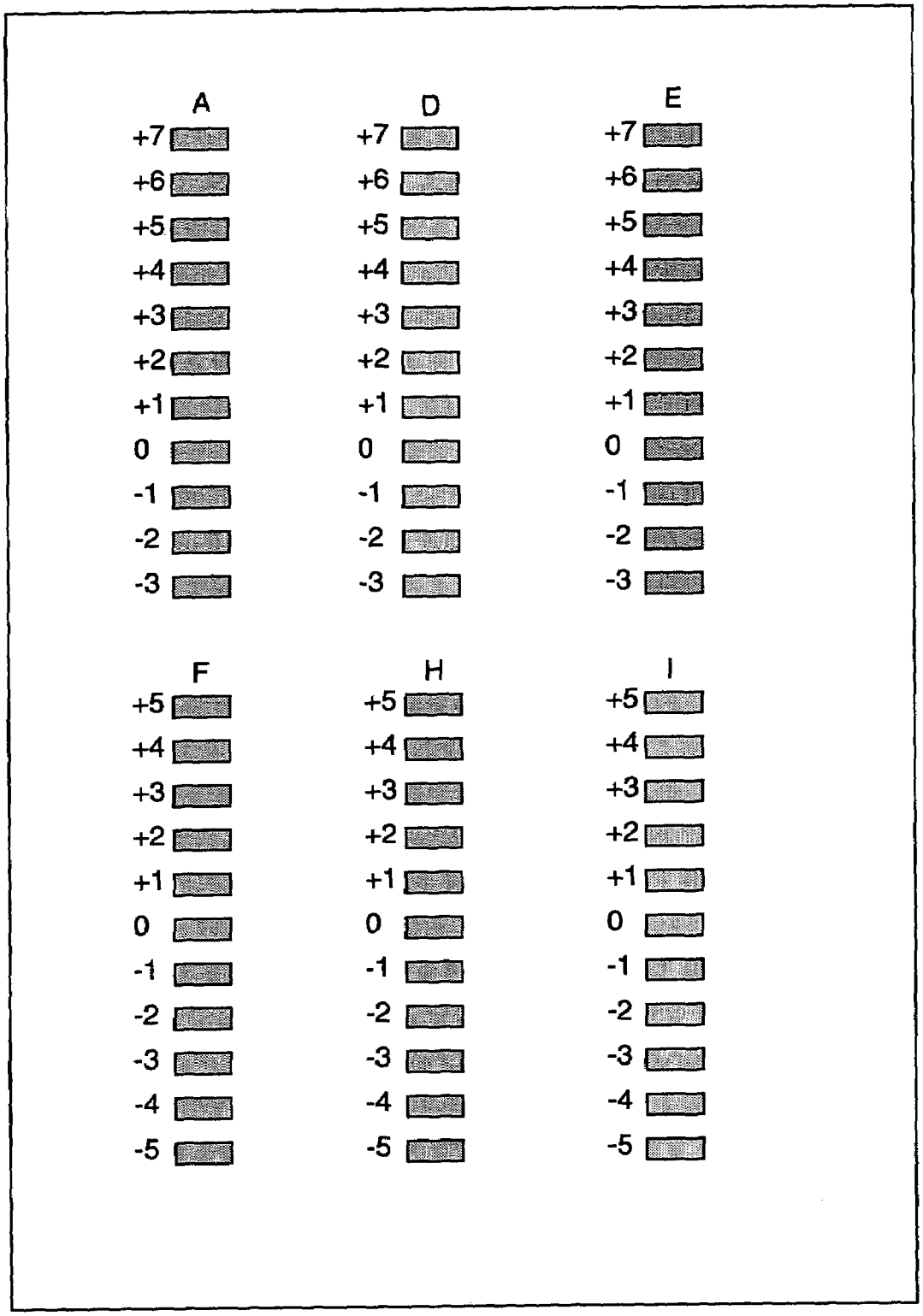
FIG. 7 shows an example of print position adjustment patterns printed in the first embodiment of the invention.

In two nozzle lines that need to be adjusted in their relative print position, a drive timing of one nozzle line is progressively shifted from a drive timing of the second nozzle line taken as a reference to change their relative print position and thereby print a plurality of print position adjust patterns (step S1301). In this example, as shown in FIG. 7, six groups of patterns (A, D, E, F, H, I) are printed in the print mode A, with the drive timing changed in 11 steps (from +7 to −3, or from +5 to −5) according to the nozzle lines to be subjected to the print position adjustment described later. In next step S1302, in each group of patterns, the user selects from among 11 patterns one having the most appropriate print position and extracts a print position setting value (from +7 to −3, or from +5 to −5) of the selected pattern. The setting values for all six pattern groups are stored in a nonvolatile memory (EEPROM) in the printing apparatus in step S1303. In next step S1304, based on the stored setting values, a relative drive timing shift value (print position adjust value) for the nozzle lines being adjusted is calculated.

The six groups of patterns A, D, E, F, H, I shown in FIG. 7, which are printed in the print mode A, are used in adjusting the relative print position between the following nozzle lines and are printed by using the nozzle lines under adjustment. At least pattern groups F, I are printed by performing a bidirectional printing capable of printing an image in both of the forward and backward scans of the print head.

A: Black even-numbered line large nozzles B(Le) and black odd-numbered line large nozzles B(Lo);

D: Cyan even-numbered line small nozzles C(Le-1) and cyan odd-numbered line small nozzles C(Lo-1);

E: Magenta even-numbered line small nozzle M(Le-1) and magenta odd-numbered line small nozzles M(Lo-1);

F: One nozzle line for ejecting black ink during forward printing scan (black even-numbered line large nozzles B(Le) or black odd-numbered line large nozzles B(Lo)) and one nozzle line for ejecting black ink during backward printing scan (preferably both nozzle lines are the same);

H: One nozzle line for ejecting black ink and one small-nozzle line for ejecting color ink (desirably cyan or magenta ink);

I: One small-nozzle line for ejecting color ink (desirably cyan or magenta ink) during forward printing scan and one small-nozzle line for ejecting color ink (preferably cyan or magenta ink) during backward printing scan (preferably both small-nozzle lines are the same).

In this example, the nozzle lines used to print the print position adjust patterns in the print mode A are only the small-nozzle lines of the first nozzle group among the color ink nozzle lines. And no large-nozzle lines of the second nozzle group are used for pattern printing. Thus, compared to the case where both of the first and second nozzle group are used in printing the print position adjust patterns, the above process can reduce the time and the volume of ink required to print the print position adjust patterns. This process can also reduce the number of print position adjust patterns to be printed and thereby alleviate the burden of extracting a print position setting value from the printed result of the print position adjust patterns.

As described above, after the print position adjust patterns are printed in the print mode A, the user selects a setting value based on the printed result and then manually inputs the setting value from a host device connected to the printing apparatus. That is, when the print position adjust patterns of FIG. 7 are printed, the print position setting value in step S1302 and S1303 in FIG. 6 is picked up from each of the pattern groups A, D, E, F, H, I. In other words, a total of six setting values are obtained. As to the setting values for the nozzle lines that are not used in printing the print position adjust patterns (e.g., yellow even-numbered line large nozzles/odd-numbered line large nozzles), other inter-nozzle line setting values are used.

FIG. 8 to FIG. 12 are diagrams for explaining the print position adjust pattern group A as a representative case.

Figure 8:
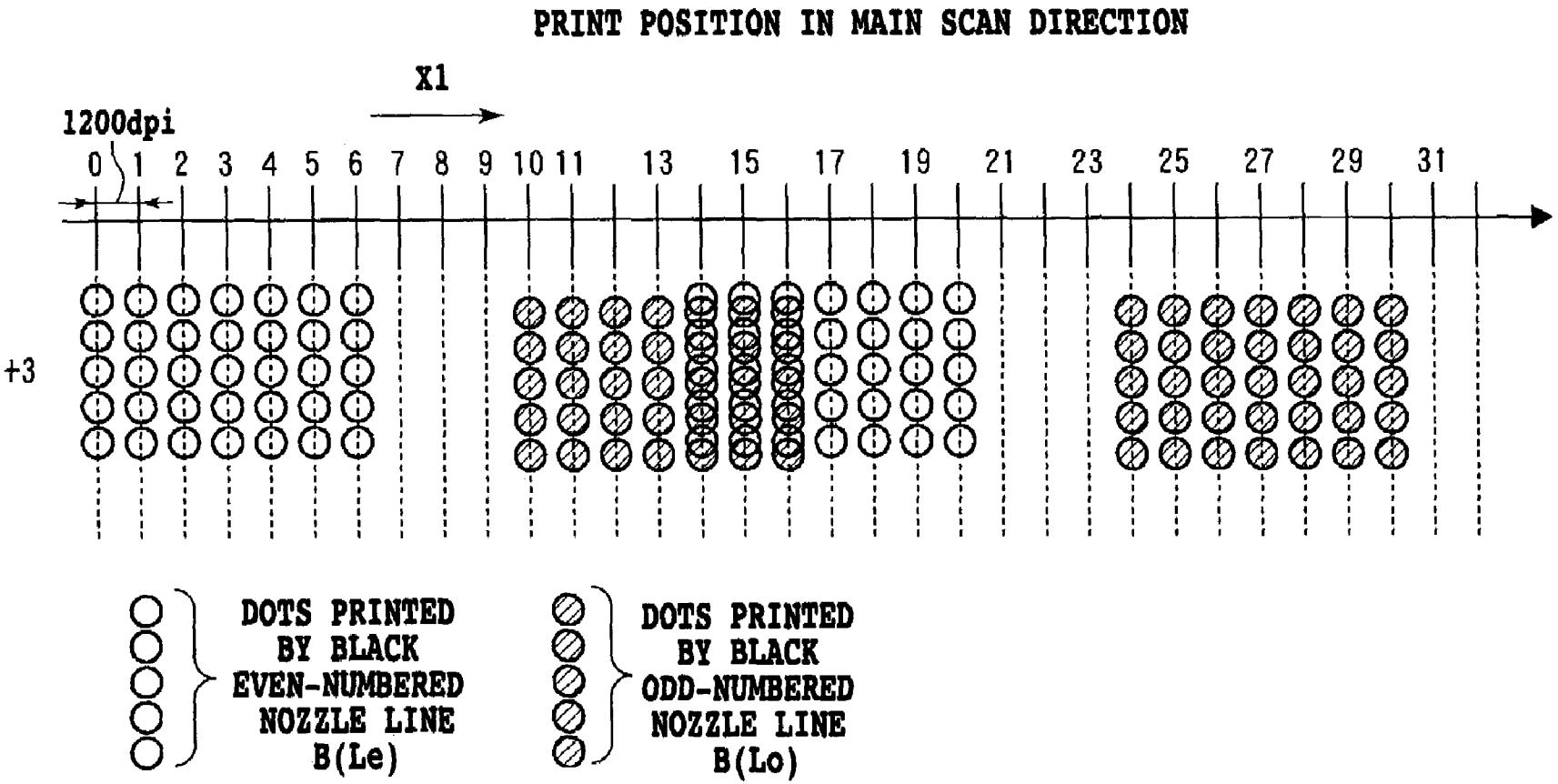
FIG. 8 is an explanatory diagram showing dot print positions of that portion of a pattern A shown in FIG. 7 which is printed at a setting of +3.

FIG. 8 is an enlarged view of dots in that pattern among 11 print position adjust patterns of the group A of FIG. 7 which is printed under the condition of setting value of +3. The examples of FIG. 8 to FIG. 12 assume that the print position is optimal when the patterns are printed at the setting value of 0. Under this assumption, these figures represent adjust patterns printed at the respective settings indicated. An abscissa shows a print position in the main scan direction and unit scales in the figures represent 1200 dpi and a setting value of 1. Dots are printed, from left to right in the figures, in an increasing order of position value on the abscissa. White circles in the figures are dots printed by the black even-numbered line B(Le) and hatched circles are dots printed by the black odd-numbered line B(Lo).

FIG. 8 shows an example of dot pattern formed by performing seven consecutive activations (seven 1-column printing actions), followed by seven consecutive nonactivations (seven 1-column nonprinting actions), by using the black even-numbered line B(Le) and the black odd-numbered line B(Lo) and then repeating the above sequence of operations during one printing scan in the direction of arrow X1. In this example, one activation (one printing action) moves the print position a distance of 1200 dpi. More specifically, dots printed by the black even-numbered line B(Le) are formed at positions 0-6 and 14-20 in the main scan direction and dots printed by the black odd-numbered line B(Lo) are formed at positions 10-16 and 24-30 in the main scan direction. At three positions 14-16, the dots printed by the two nozzle lines B(Le) and B(Lo) overlap.

Figure 9:
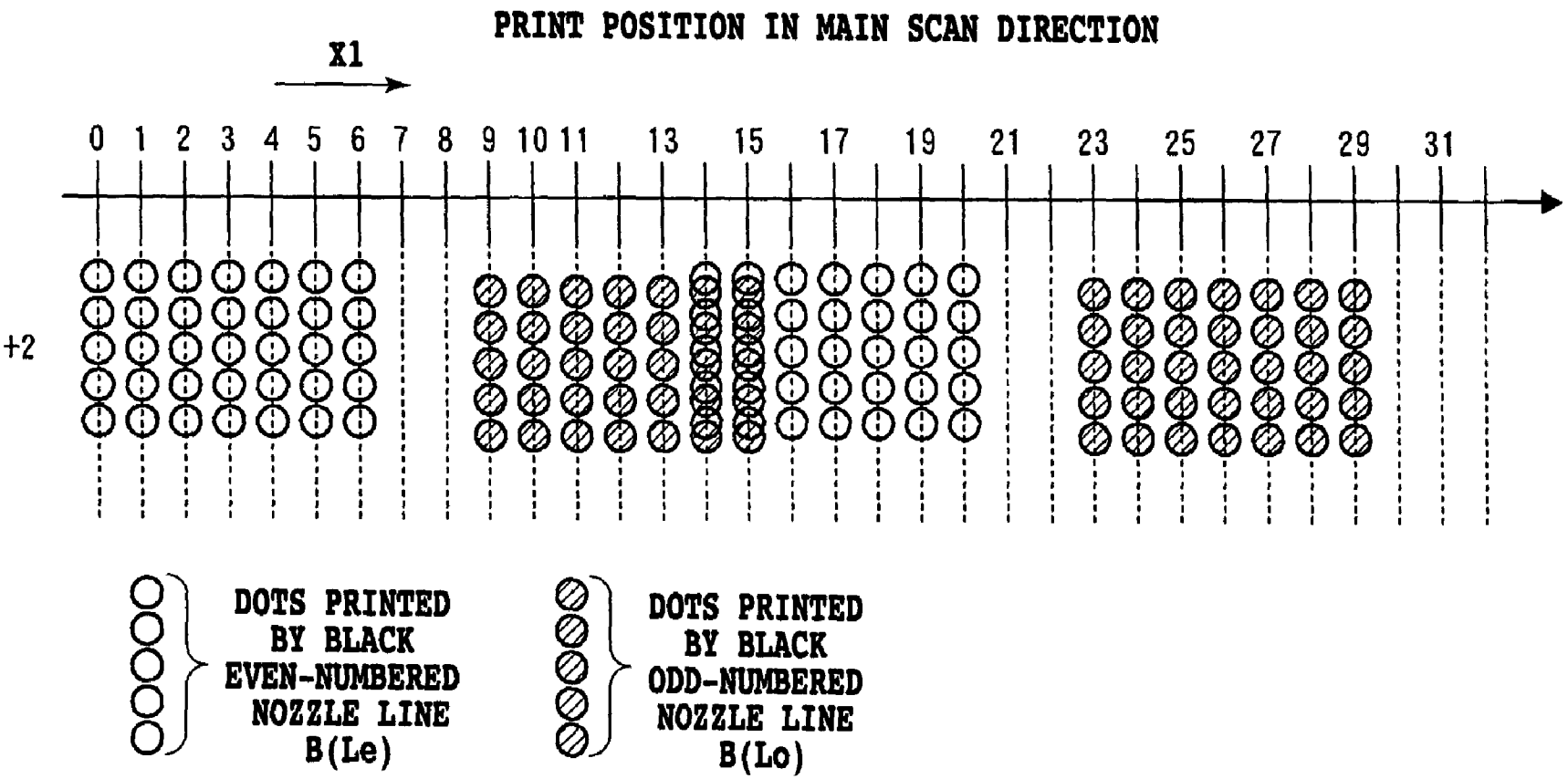
FIG. 9 is an explanatory diagram showing dot print positions of that portion of a pattern A shown in FIG. 7 which is printed at a setting of +2.

FIG. 9 is an enlarged view of dots in that pattern of the group A of FIG. 7 which is printed under the condition of setting value of +2.

A difference from FIG. 8 is that the drive timing of the black odd-numbered line B(Lo) is shifted 1200 dpi to the left in FIG. 9, with the drive timing of the black even-numbered line B(Le) left unchanged. That is, the drive timing of the black odd-numbered line B(Lo) is advanced 1200 dpi to shift the printed dot position 1200 dpi to the left in FIG. 9. As a result, as shown in FIG. 9, although the dots printed by the black even-numbered line B(Le) are formed at the same positions 0-6 and 14-20 as in FIG. 8, the dots printed by the black odd-numbered line B(Lo) shifts left to positions 9-15 and 23-29. Therefore, the dots printed by the two nozzle lines B(Le) and B(Lo) overlap at two positions 14 and 15.

Figure 10:
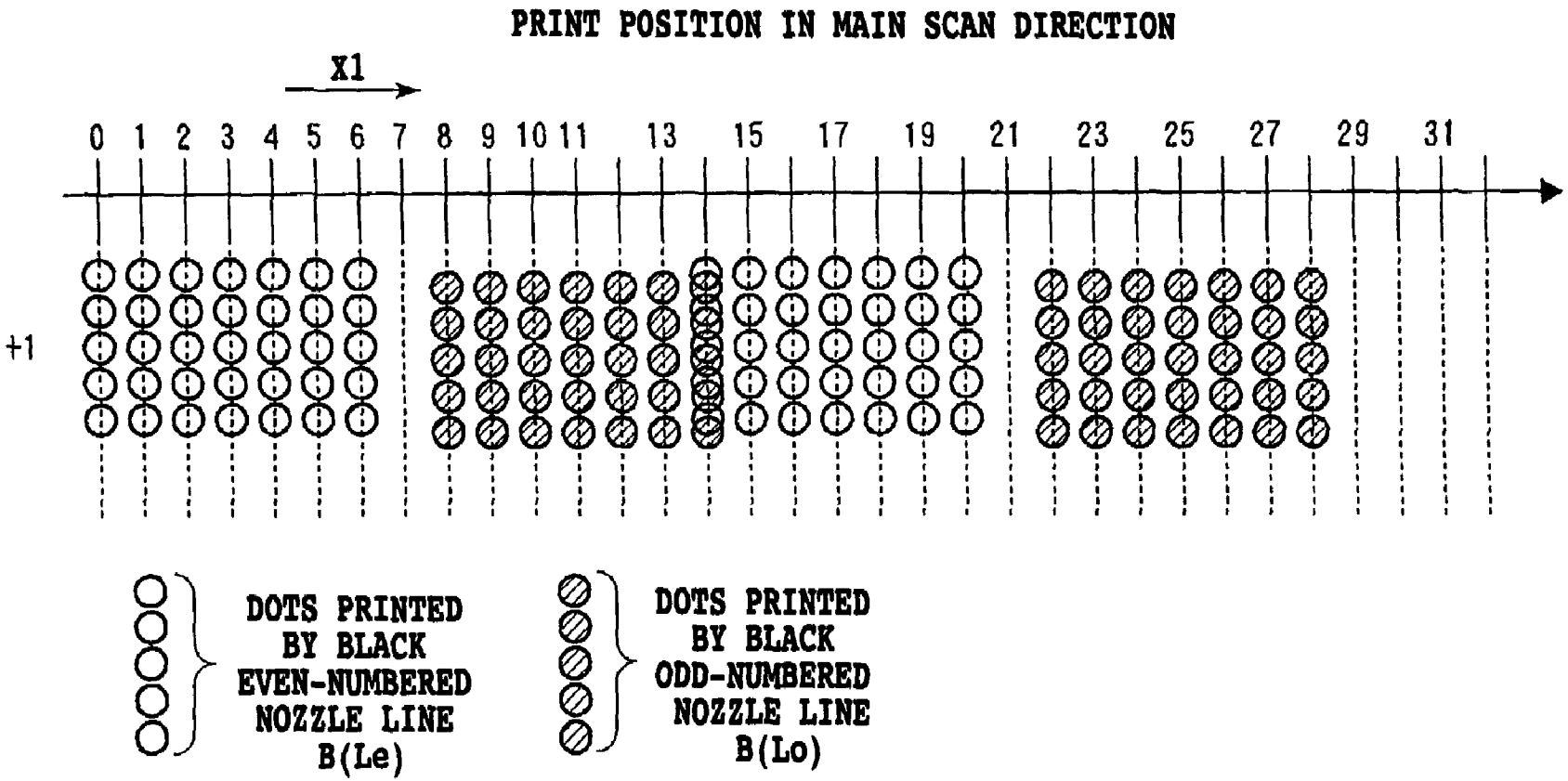
FIG. 10 is an explanatory diagram showing dot print positions of that portion of a pattern A shown in FIG. 7 which is printed at a setting of +1.

FIG. 10 is an enlarged view of dots in that pattern of the group A of FIG. 7 which is printed under the condition of setting value of +1. What differs from FIG. 9 is that the positions of the dots printed by the black odd-numbered line B(Lo) are shifted 1200 dpi further to the left. That is, the drive timing of the black odd-numbered line B(Lo) is further advanced by the length of time corresponding to 1200 dpi.

Figure 11:
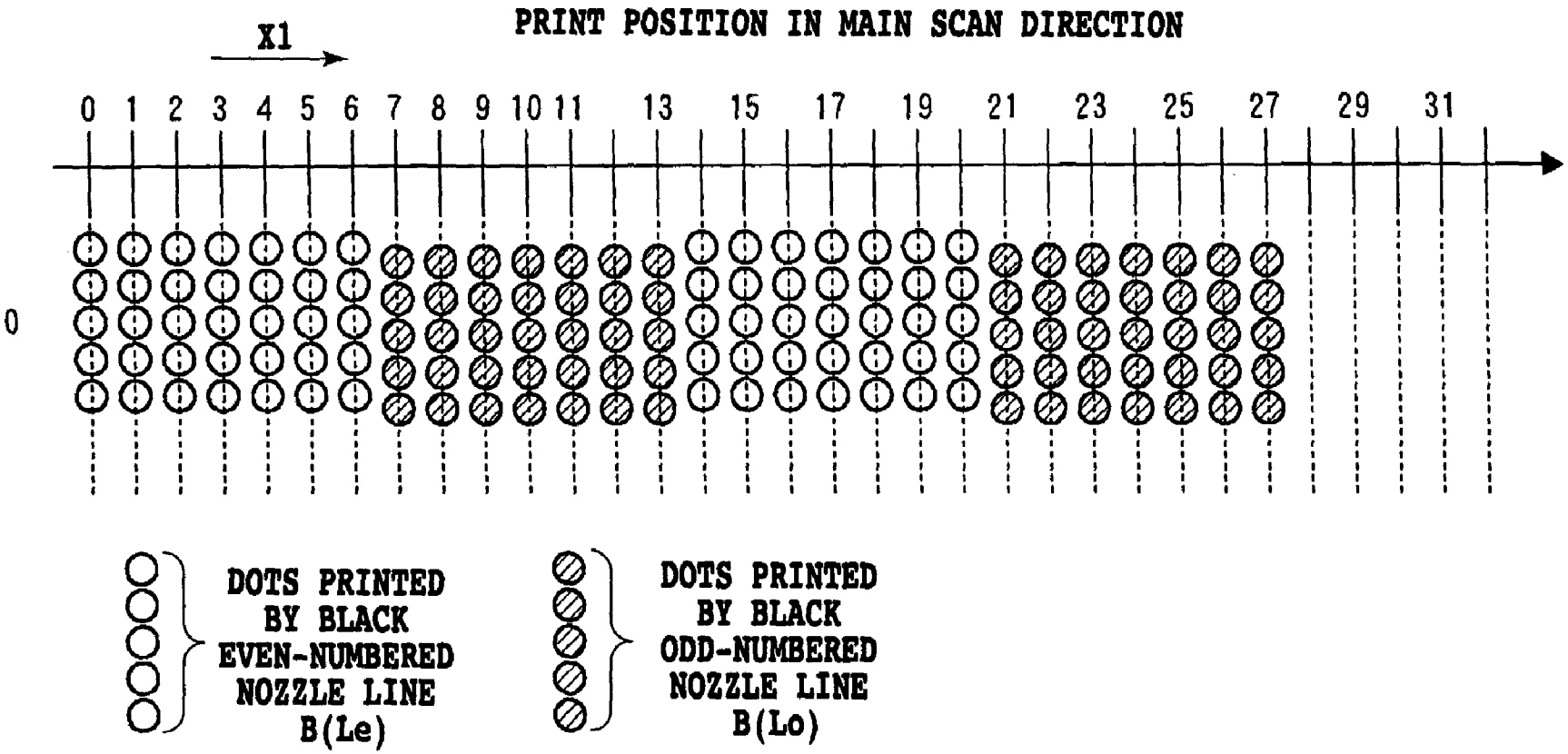
FIG. 11 is an explanatory diagram showing dot print positions of that portion of a pattern A shown in FIG. 7 which is printed at a setting of 0.

FIG. 11 is an enlarged view of dots in that pattern of the group A of FIG. 7 which is printed under the condition of setting value of 0. What differs from FIG. 10 is that the positions of the dots printed by the black odd-numbered line B(Lo) are shifted 1200 dpi further to the left. That is, the drive timing of the black odd-numbered line B(Lo) is further advanced by the length of time corresponding to 1200 dpi.

Figure 12:
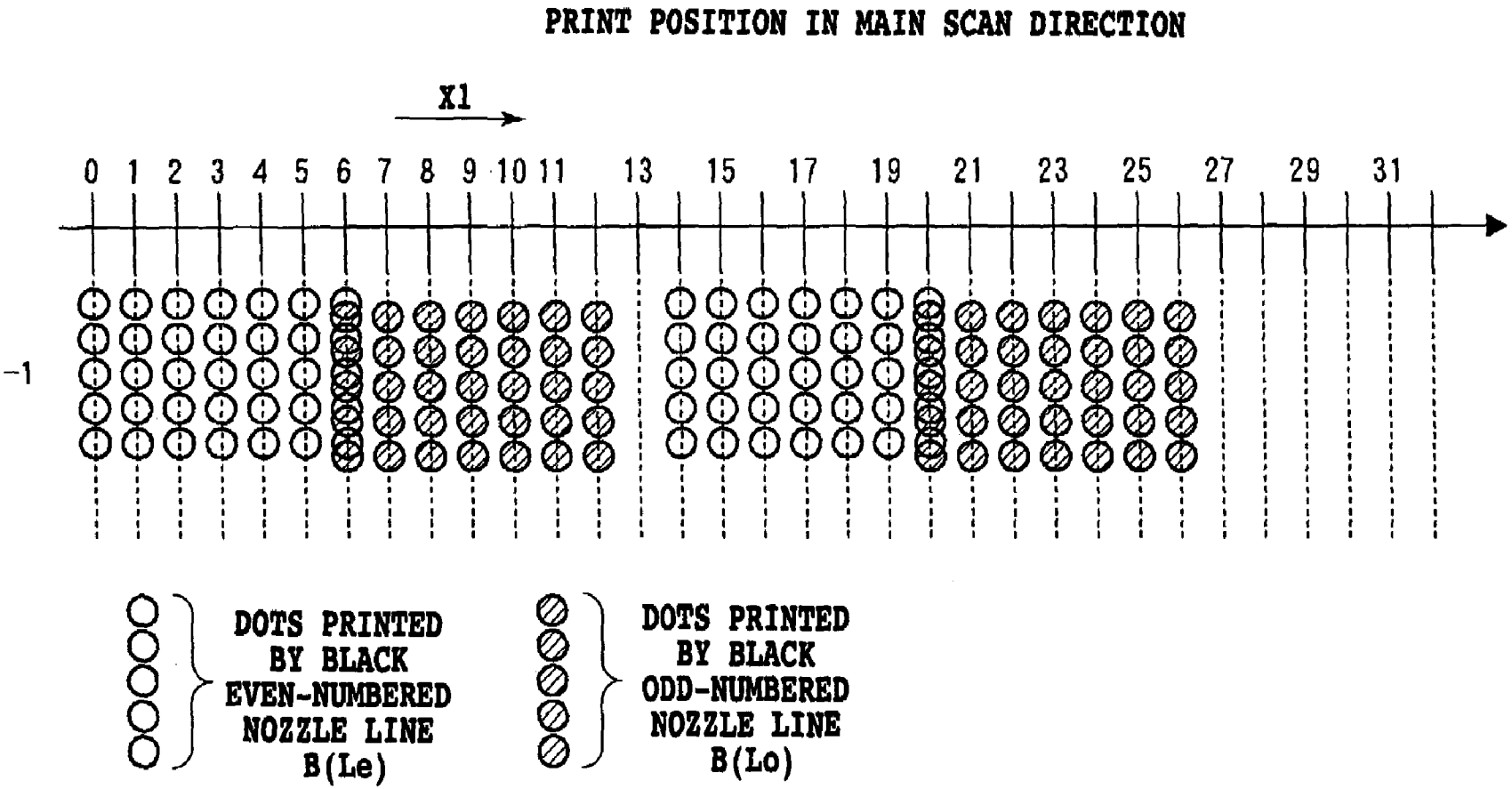
FIG. 12 is an explanatory diagram showing dot print positions of that portion of a pattern A shown in FIG. 7 which is printed at a setting of −1.

FIG. 12 is an enlarged view of dots in that pattern of the group A of FIG. 7 which is printed under the condition of setting value of −1. What differs from FIG. 11 is that the positions of the dots printed by the black odd-numbered line B(Lo) are shifted 1200 dpi further to the left. That is, the drive timing of the black odd-numbered line B(Lo) is further advanced by the length of time corresponding to 1200 dpi.

As described above, by progressively changing the drive timing of only the black odd-numbered line B(Lo) without changing the drive timing of the black even-numbered line B(Le), the positions of the dots printed by the black odd-numbered line B(Lo) are progressively shifted, thus changing the relative print positions of dots formed by the two nozzle lines B(Le) and B(Lo).

After the pattern group A is printed by incrementally changing the setting value of the same pattern for a total of 11 different setting values, a pattern in which the dots printed by the two nozzle lines B(Le) and B(Lo) have the smoothest joint portion is selected. Whether the joint portion is smooth or not can be visually determined because a differing thickness of white line at the joint portion shows in the pattern. In this example, of the patterns shown in FIG. 8 to FIG. 12, a pattern of FIG. 11 shows almost no white line at the joint portion. So, this pattern printed under the condition of FIG. 11 is selected. Thus, the setting value of 0 is picked up and stored.

When both nozzle lines B(Le) and B(Lo) are driven to print images under the condition of the same setting value of 0 as in FIG. 11, the positions of dots printed by these nozzle lines B(Le) and B(Lo) are shifted seven 1200-dpi column positions (7 dots) in the main scan direction. For example, if the black even-numbered nozzle line B(Le) is activated at the same timing as it was when forming dots at a print position 0 as shown in FIG. 11 and if the black odd-numbered nozzle line B(Lo) is activated at the same timing as it was when forming dots at a print position 7 as shown in FIG. 11, then the positions of these dots are shifted seven 1200-dpi column positions in the main scan direction. This means that advancing the drive timing of the black odd-numbered nozzle line B(Lo) by seven column positions from the drive timing of FIG. 11 can adjust the positions of the dots printed by the both nozzle lines B(Le) and B(Lo) so that they assume the same positions.

As described above, the positions of dots printed by the two nozzle lines B(Le) and B(Lo) can be adjusted to take up the same positions by adjusting the drive timings of the black even-numbered nozzle line B(Le) and the black odd-numbered nozzle line B(Lo) based on the setting value obtained from the printed result of the print position adjust pattern group A. This also applies to other print position adjust pattern groups D, E, F, H, I. That is, with one of two nozzle lines to be adjusted taken as a reference (its drive timing is left unchanged), the drive timing of the other nozzle line is shifted 1200 dpi at a time during the course of printing the patterns. A plurality of patterns (in this example, 11 patterns) are printed by changing the relative print position between the two nozzle lines of interest. Of the printed patterns, one with the smoothest appearance is selected and the print position setting value between the nozzle lines being adjusted is obtained.

As described above, the print position setting values V1-V9 determined based on the printed result of the print position adjust pattern groups and the print position adjust values AV1-AV16 determined based on the print position setting values V1-V9 have the following relation.

[Print Position Setting Values]

V1: Setting value between B(Le) and B(Lo) . . . Pattern group A

V2: Setting value between C(Le-1) and C(Lo-1) . . . Pattern group D

V3: Setting value between M(Le-1) and M(Lo-1) . . . Pattern group E

V4: Setting value between Y(Le-1) and Y(Lo-1) . . . Pattern group E (same setting value as V3 is shared)

V5: Setting value between forward and backward scans of black ink nozzle line . . . Pattern group F V6: Setting value between forward and backward scans of color ink nozzle line . . . Pattern group I V7: Setting value between forward and backward scans of magenta (M) small-nozzle line . . . Pattern group I (same setting value as V6 is shared)

V8: Setting value between forward and backward scans of yellow (Y) small-nozzle line . . . Pattern group I (same setting value as V6 is shared)

V9: Setting value between black ink nozzle line and one of color ink nozzle lines . . . Pattern group H

[Print Position Adjust Values]

AV1: Fwd1200[cE]=−V9
AV2: Fwd1200[cO]=−V9+V2
AV3: Fwd1200[mE]=−V9
AV4: Fwd1200[mO]=−V9+V3
AV5: Fwd1200[yE]=−V9
AV6: Fwd1200[yO]=−V9+V4
AV7: Fwd1200[BkE]=0
AV8: Fwd1200[BkO]=V1
AV9: Bwd1200[cE]=−V9−V6
AV10: Bwd1200[cO]=−V9+V2−V6
AV11: Bwd1200[mE]=−V9−V7
AV12: Bwd1200[mO]=−V9+V2−V7
AV13: Bwd1200[yE]=−V9−V8
AV14: Bwd1200[yO]=−V9+V4−V8
AV15: Bwd1200[BkE]=−V5
AV16: Bwd1200[BkO]=−V5+V1

The symbols in the above print position adjust values have the following meaning:

Fwd1200: Resolution in the forward scan is 1200 dpi
Bwd1200: Resolution in the backward scan is 1200 dpi
[cE]: C(Le-1)
[cO]: C(Lo-1)
[mE]: M(Le-1)
[mO]: M(Lo-1)

[yE]: Y(Le-1)
[yO]: Y(Lo-1)
[BkE]: B(Le)
[BkO]: B(Lo)

[0071]

Figure 13:
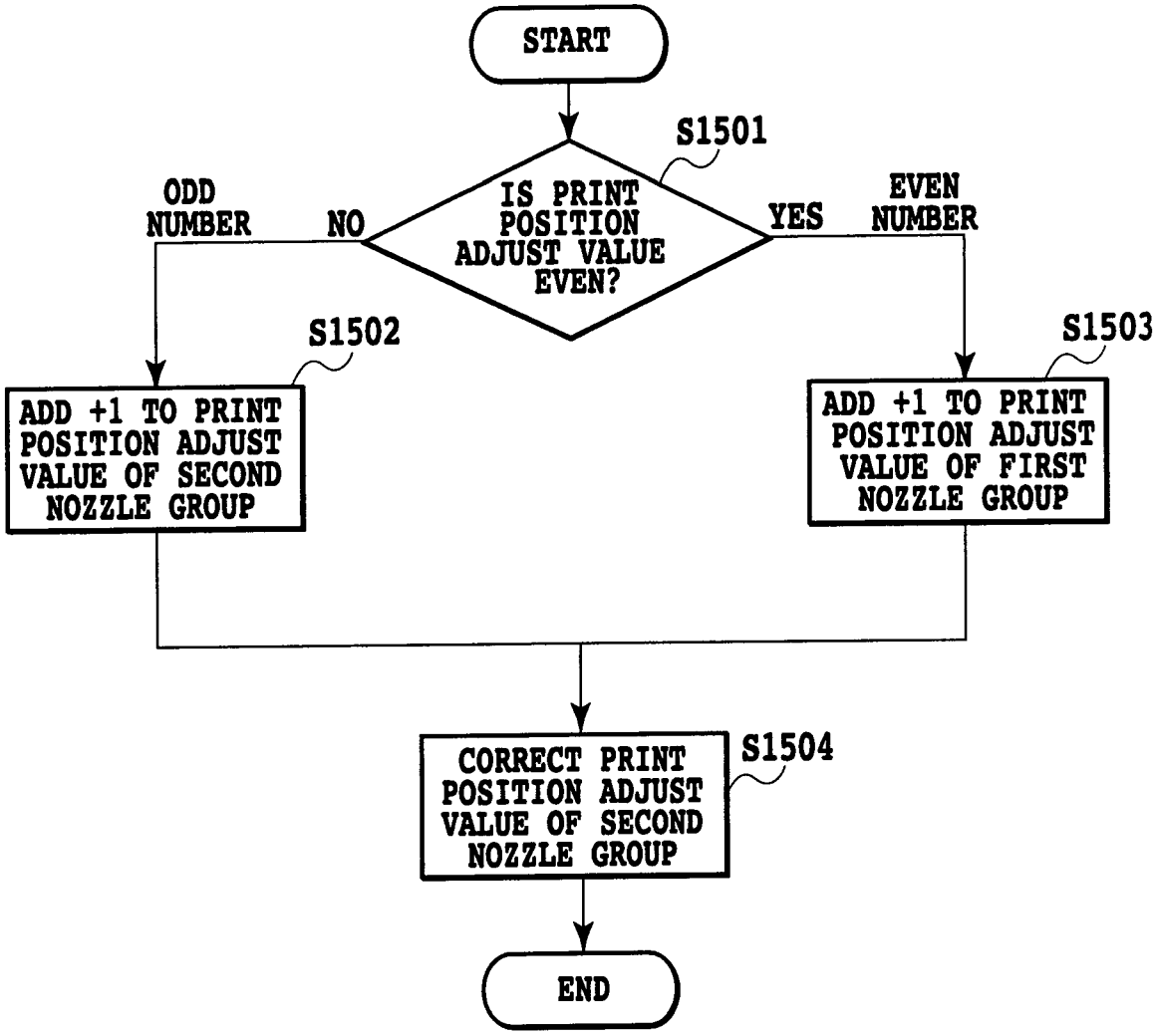
FIG. 13 is a flow chart showing a process of correcting a print position adjust value in the first embodiment of the invention.

FIG. 13 is a flow chart explaining a correction operation (also referred to as "nozzle group print position adjust value correction operation") for print mode, based on the print position adjust values set as shown above.

First, step S1501 checks whether the print position adjust value set for each nozzle line is even or odd. For a nozzle line whose print position adjust value is determined as being odd, if it is included in the second nozzle group (large-nozzle line), the print position adjust value is incremented by +1 (1/1200 inch) (step S1502) before moving to step S1504. For a nozzle line whose print position adjust value is determined to be even by step S1501, if it is included in the first nozzle group (small-nozzle line), the print position adjust value is incremented by +1 (1/1200 inch) (step S1503) before moving to step S1504. Step S1504 also adds to the print position adjust value for the nozzle line included in the second nozzle group (large-nozzle line) a relative print timing correction value between the first and second nozzle group prepared in advance (available in unit of an integer times 1/600 inch). This correction value is set based on the printed result of the print position adjust patterns.

In the following, the cyan odd-numbered line small nozzles C(Lo-1) and the cyan even-numbered line small nozzles C(Le-1), both included in the first nozzle group, and the cyan odd-numbered line large nozzles C(Lo-2) and the cyan even-numbered line large nozzles C(Le-2), both included in the second nozzle group, are taken up as an example to give detailed explanations about the nozzle group print position adjust value correction operation of FIG. 13 to be performed on these nozzle lines.

First, a correction value to be added in step S1504 will be explained by referring to FIG. 14.

In a printing operation using a small-nozzle line and a large-nozzle line, the ink ejection speed may vary between these nozzle lines. Thus, if these nozzle lines are driven at the same timings, the ink landing positions on the print medium 8 may differ between the two nozzle lines, i.e., a position deviation may occur between small dots and large dots. FIG. 14 shows dot landing positions when ink is ejected from the cyan odd-numbered line small nozzles C(Lo-1) and the cyan odd-numbered line large nozzles C(Lo-2) at the same timings. In FIG. 14, when the nozzle drive timings are set for the odd-numbered column position (0) and the even-numbered column position (E) separately, the drive timings TA, TB for the nozzle lines C(Lo-1) and C(Lo-2) are matched to that of the even-numbered column position (E). As a result, the landing positions of ink ejected from these nozzle lines deviate from each other, with the large dot forming position PD shifted four column positions to the left from the small dot forming position Pd, as indicated by solid circle in FIG. 14. The amount of such a positional deviation can be determined from the printed result of the print position adjust patterns printed in the print mode A which, as described above, drives the first and second nozzle group separately.

In this example, since there is a deviation of four column positions, the correction value to be added to the print position adjust value for the cyan odd-numbered line large nozzles C(Lo-2) is set to "4" in step S1504. By adding this correction value of "4", the large dot forming position PD can be made to coincide with the small dot forming position Pd, as indicated by broken circle in FIG. 14.

Figure 14:
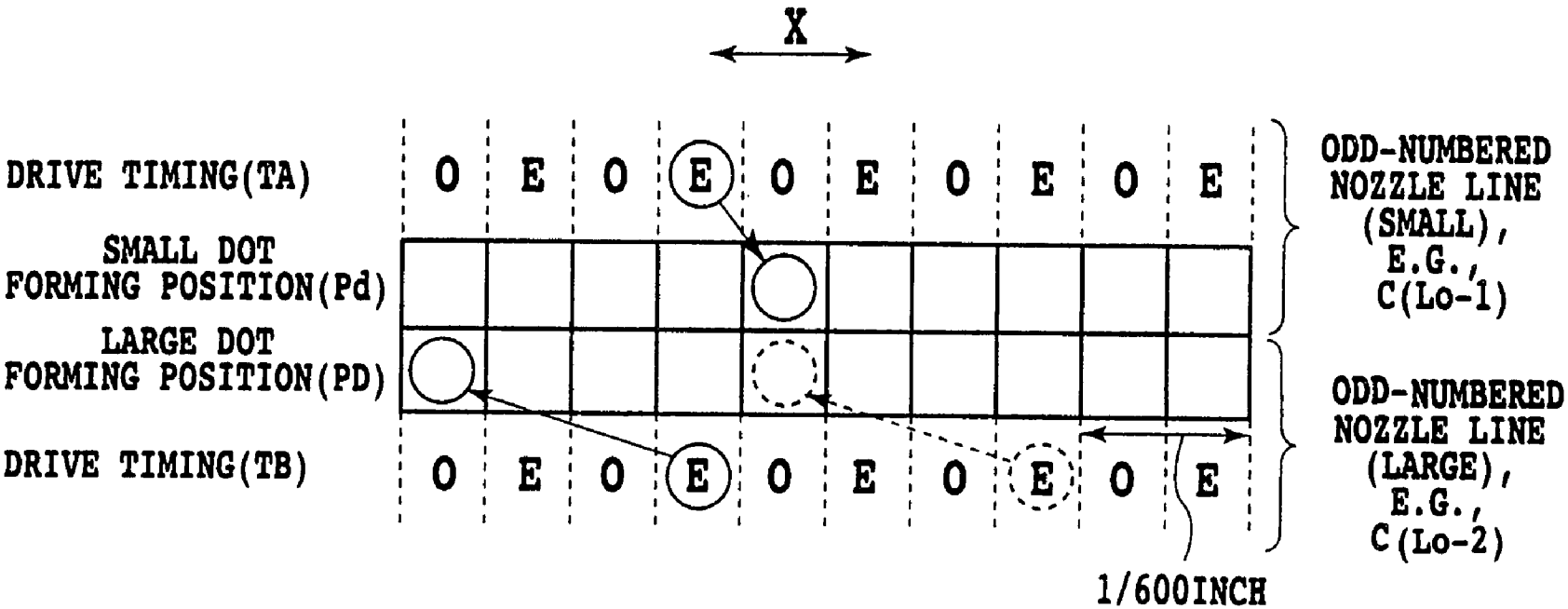
FIG. 14 is an explanatory diagram showing a relation between a dot print timing and a dot print position in the first embodiment of the invention.

As a correction value like the one shown in FIG. 14, a total of six correction values can be prepared, which are: a correction value for cyan odd-numbered line large and small nozzles C(Lo-1), C(Lo-2); a correction value for cyan even-numbered line large and small nozzles C(Le-1), C(Le-2); a correction value for magenta odd-numbered line large and small nozzles M(Lo-1), M(Lo-2); a correction value for magenta even-numbered line large and small nozzles M(Le-1), M(Le-2); a correction value for yellow odd-numbered line large and small nozzles Y(Lo-1), Y(Lo-2); and a correction value for yellow even-numbered line large and small nozzles Y(Le-1), Y(Le-2).

FIG. 15A to FIG. 15D are explanatory diagrams showing the correction operations performed on the first nozzle group.

Performing the print position adjustment on the cyan odd-numbered line small nozzles C(Lo-1) and the cyan even-numbered line small nozzles C(Le-1) by using the above-described print position adjust values can cause these nozzles eject ink to form small dots at the same positions Pd, as shown to the left in FIG. 15A to FIG. 15D.

In the print mode A, the drive timings of small nozzles and large nozzles are not limited to only the odd-numbered column positions or the even-numbered column positions. In the print mode B, however, the drive timings of small nozzles are limited to only the odd-numbered column positions (O) and the drive timings of large nozzles are limited to only the even-numbered column positions (E). In this example, when the print position adjust value is even, the dot forming positions in the print mode B match those of the even-numbered column positions (E). When the print position adjust value is odd, the dot forming positions in the print mode B match those of the odd-numbered column positions (O).

Figure 15A:
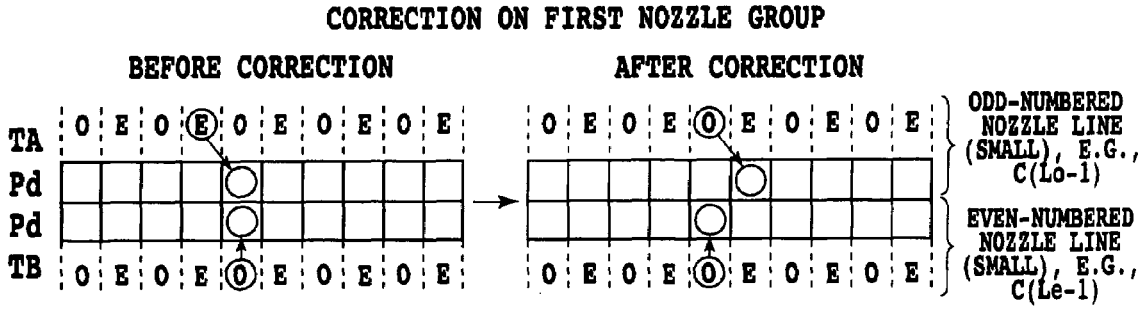
FIG. 15A, FIG. 15B, FIG. 15C and FIG. 15D are explanatory diagrams showing a correction process for a first nozzle group in the first embodiment of the invention.

Therefore, if performing the correction on the nozzle line C(Lo-1) by using the even-numbered print position correction value results in its drive timing TA falling on an even-numbered column position (E), as shown to the left side of FIG. 15A, since the activation of the C(Lo-1) at the even-numbered column position is not allowed, the drive timing TA needs to be corrected to fall on an odd-numbered column position (O). Hence, step S1503 of FIG. 13 adds "1" to the even print position adjust value to match the drive timing TA of the nozzle line C(Lo-1) to an odd-numbered column position (O), as shown in an after-correction diagram to the right of FIG. 15A.

Figure 15B:
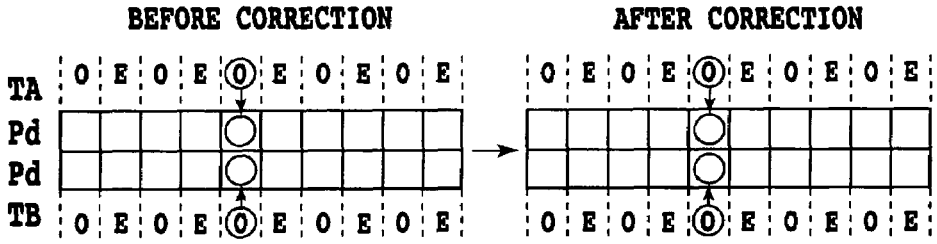
Figure 15C:
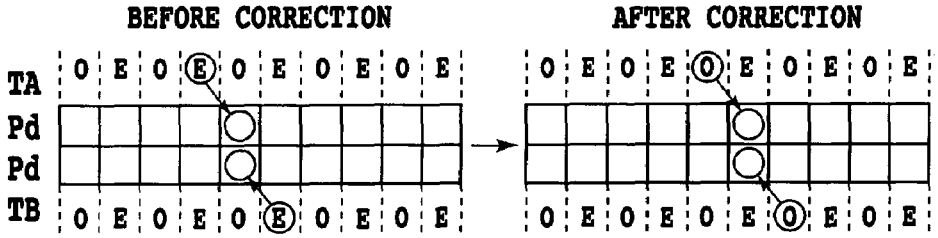
Figure 15D:
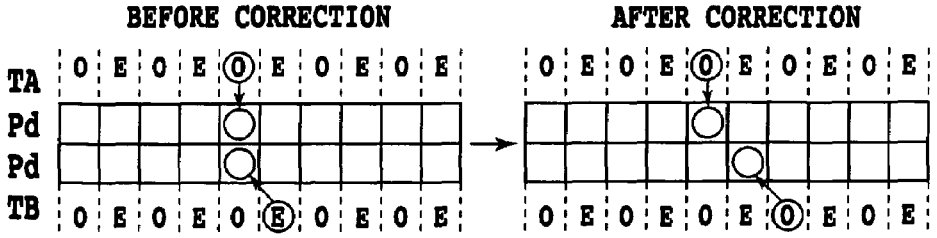

In the case of FIG. 15B, since the print position adjust value is odd, it is not necessary to add "1" to the adjust value. In the case of FIG. 15C, "1" is added to each of the print position adjust values of the nozzle lines C(Lo-1) and C(Le-1). In the case of FIG. 15D, "1" is added to the print position adjust value of the nozzle line C(Le-1).

FIG. 16A to FIG. 16D are explanatory diagrams showing an example correction operation performed on the second nozzle group.

Performing the above-described print position adjustment on the cyan odd-numbered line large nozzles C(Lo-2) and the cyan even-numbered line large nozzles C(Le-2) by using the above-described print position adjust values can cause these nozzles eject ink to form large dots at the same positions PD, as shown to the left in FIG. 16A to FIG. 16D.

Figure 16A:
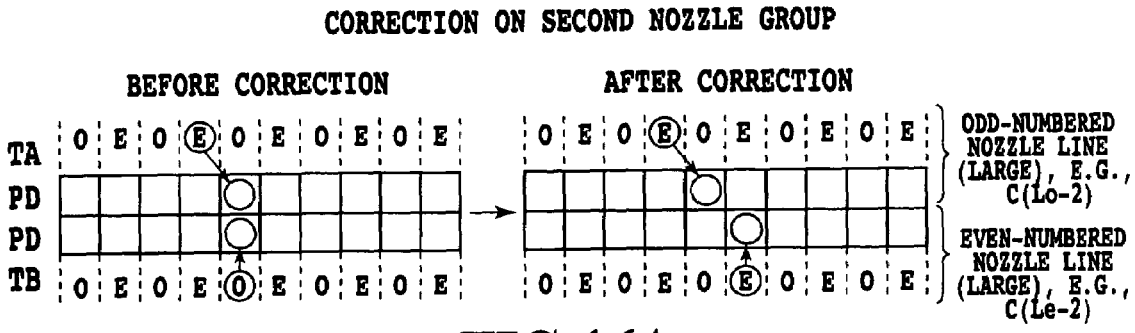
FIG. 16A, FIG. 16B, FIG. 16C and FIG. 16D are explanatory diagrams showing a correction process for a second nozzle group in the first embodiment of the invention.

If performing the correction on the nozzle line C(Le-2) by using the odd print position adjust value results in its drive timing TB falling on an odd-numbered column position (O), as shown to the left side of FIG. 16A, since the activation of the C(Le-2) at the odd-numbered column position is not allowed, the drive timing TB needs to be corrected to fall on an even-numbered column position (E). Hence, step S1502 of FIG. 13 adds "1" to the odd print position adjust value to match the drive timing TB of the nozzle line C(Le-2) to an even-numbered column position (E), as shown in an post-correction diagram to the right of FIG. 16A.

Figure 16B:
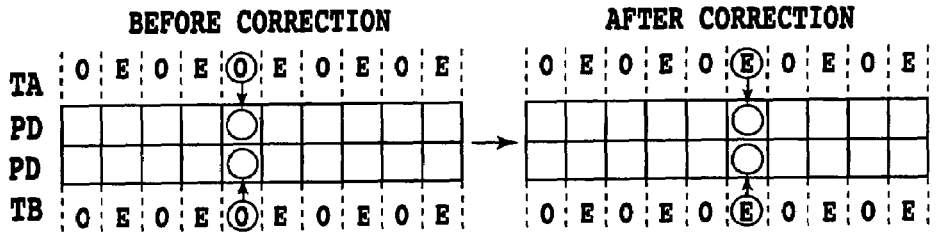
Figure 16C:
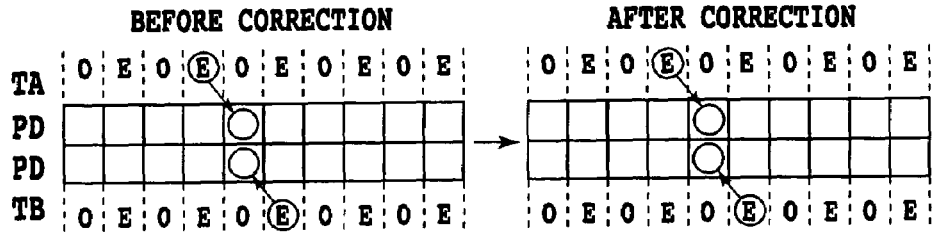
Figure 16D:
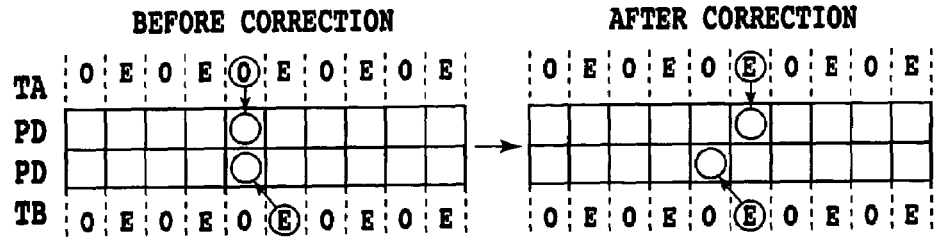

In the case of FIG. 16B, both of the print position adjust values are odd, so "1 " is added to each of the print position adjust values of the nozzle lines C(Lo-2) and C(Le-2). In the case of FIG. 16C, since the print position adjust values are both even, there is no need to add "1". In the case of FIG. 16D, "1" is added to the print position adjust value of the nozzle line C(Lo-2).

Since the print position adjust value is corrected according only to the decision as to whether the print position adjust value is odd or even, this correction process can be simplified significantly. This in turn allows for a substantial simplification of generation and checking of the control program. By fixing the relative position relation between the first and second nozzle group, the process can further be simplified.

In this example, if the step S1501 of FIG. 13 decides that the print position adjust value is even, the print positions of the nozzle line of the first nozzle group are shifted; and if the print position adjust value is determined to be odd, the print positions of the nozzle line of the second nozzle group are shifted. It is noted, however, that the print position shifting is not limited to this method. The similar effect can also be produced, for example, by shifting the print positions of a nozzle line of the second nozzle group when the print position adjust value is even and, when it is odd, shifting the print positions of a nozzle line of the first nozzle group.

As described above, this embodiment first prints the print position adjust patterns in the drive mode A by using nozzle lines of the first nozzle group and, based on the printed result, determines the print position adjust value to adjust a relative print position between the nozzle lines included in the first and second nozzle group. The print mode B alternately drives the first nozzle group and the second nozzle group during at least one printing scan. Thus, based on the print position adjust value obtained from the drive mode A, the print position adjust value in the print mode B is determined. As a result, not only can the correction of the print position adjust value for the print mode B be simplified but the number of print position adjust patterns printed can be reduced, alleviating a burden on the part of the user in selecting a print position setting value.

Second Embodiment

Next, the second embodiment of this invention will be described. In the following description, parts identical with those of the first embodiment will be excluded from our explanation, which will center around parts characteristic of this embodiment.

In the first embodiment, the print position adjust value is corrected without regard to the direction of printing scan, i.e., whether the print head is performing a forward printing scan (printing scan in the forward direction) or a backward printing scan (printing scan in the backward direction). That is, this correction involves adding a correction value of +1 to a print position adjust value of the second nozzle group when the print position adjust value is odd and adding a correction value of +1 to a print position adjust value of the first nozzle group when the print position adjust value is even. Therefore, in FIG. 15A to FIG. 15D and FIG. 16A to FIG. 16D, when the drive timing TA is used as a drive timing for the forward scan and the drive timing TB as a drive timing for the backward scan, position deviations may occur between the dots printed by these drive timings. More specifically, as shown in FIG. 15A and FIG. 15D, the positions of small dots Pd printed by the first nozzle group may deviate 1/1200 inch or, as shown in FIG. 16A and FIG. 16D, the positions of large dots PD printed by the second nozzle group may deviate 1/1200 inch.

In this embodiment, the correction is made considering the direction of printing scan in order to reduce such dot position deviations as much as possible.

Figure 17:
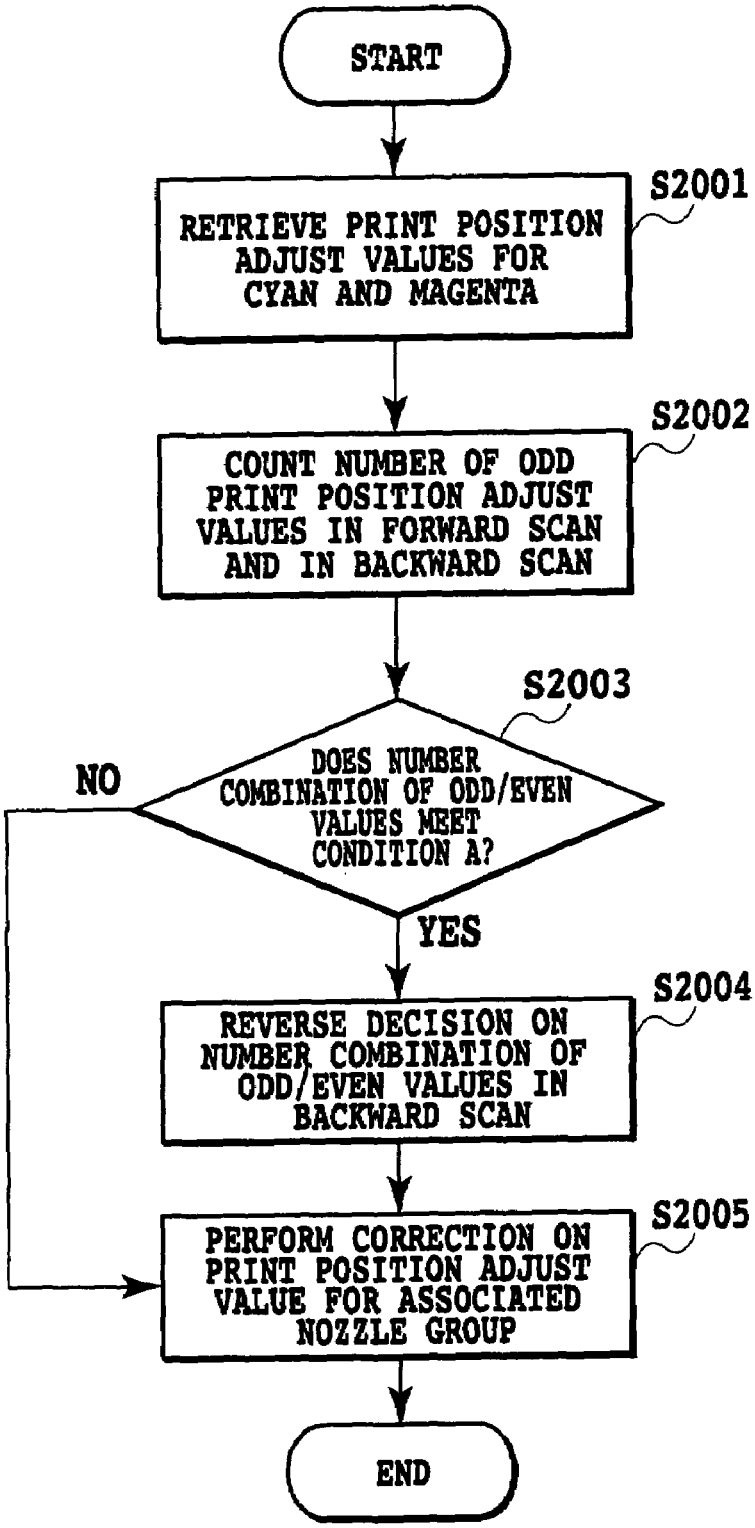
FIG. 17 is a flow chart showing a process of correcting a print position adjust value in a second embodiment of the invention.

FIG. 17 is a flow chart explaining the procedure for correcting the print position adjust value in this embodiment. In the following, an example case of forward and backward printing using the first nozzle group will be explained. The following explanation similarly applies to the forward and backward printing using the second nozzle group.

First, step S2001 retrieves print position adjust values AV1-AV4 (for forward scan) and AV9-AV12 (for backward scan) associated with nozzle lines of the first nozzle group for ejecting cyan and magenta ink. Next step S2002 counts the number of those print position adjust values AV1-AV4 used in forward scan which have odd values, Co1, and also the number of those print position adjust values AV9-AV12 used in backward scan which have odd values, Co2. Then, step S2003 checks if a combination of numbers of odd/even print position adjust values matches a combination condition A.

A check for the combination condition A determines if a combination of the number of odd values in the forward scan (Co1) and the number of odd values in the backward scan (Co2), namely ((Co1), (Co2)), matches one of (4, 0), (4, 1), (3, 0), (0, 3), (3, 1), (1, 3), (1, 4) and (0, 4).

The condition A for the eight combinations is expressed as follows:

$$ABS\{(Co1)-(Co2)\} \geqq 3$$

or $$((Co\ 1),(Co2))=(3,\ 1) \text{ or } (1,\ 3)$$

In the above formula, "ABS" represents a function that takes an absolute value.

In this example, the check covers the print position adjust values for the nozzles of cyan and magenta inks but excludes the print position adjust values for the nozzles of yellow ink. The reason is that a yellow ink, if its dots should deviate, have not so large an effect on the printed image quality as do cyan and magenta inks.

In step S2003 if the combination fails to match the condition A, the process moves to step S2005 where the print position adjust value of the associated nozzle group is corrected as shown in FIG. 13. When on the other hand step S2003 decides that the combination successfully matches the condition A, the process moves to step S2004 which leaves the print position adjust values for the forward scan unchanged and reverses the decision on the number of odd/even print position adjust values (check on the number of even/odd values). That is, print position adjust values which are even are decided as being odd and those that are odd are decided as being even. The process then proceeds to step S2005.

Next, this process is explained in more detail.

FIRST DETAILED EXAMPLE

Figure 18A:
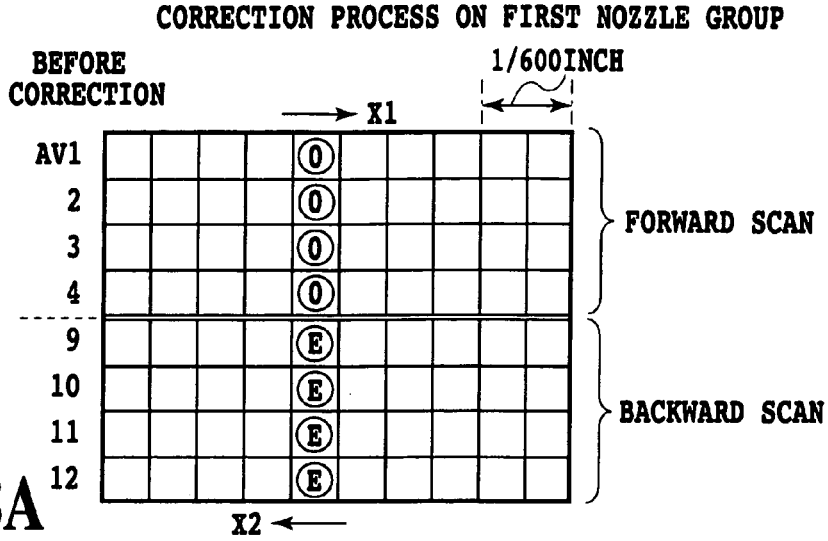
FIG. 18A, FIG. 18B and FIG. 18C are explanatory diagrams showing an example of correction process for a first nozzle group in the second embodiment of the invention.
Figure 18B:
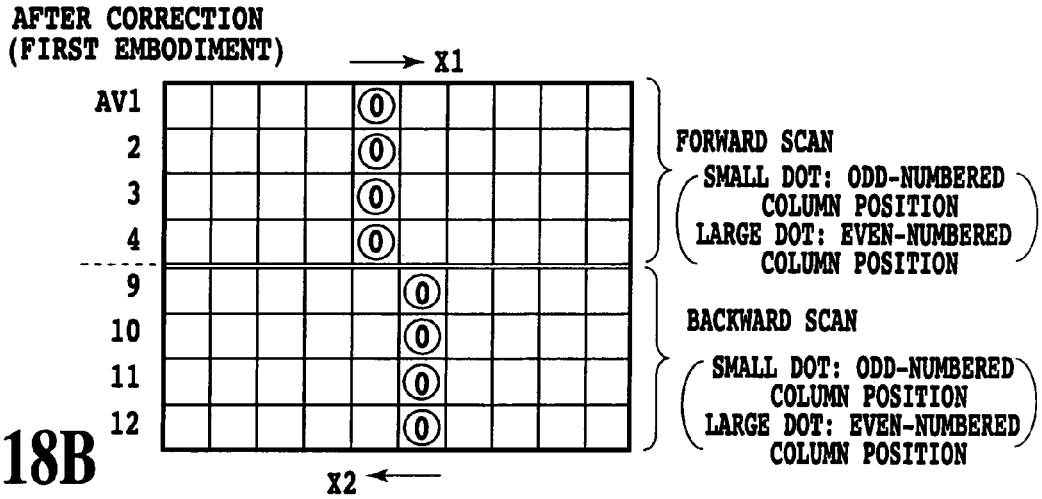
Figure 18C:
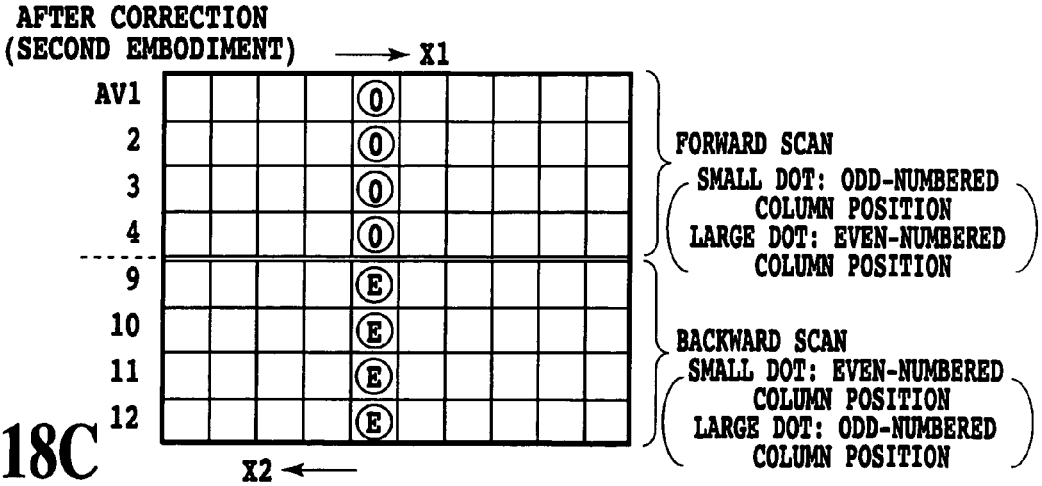

FIG. 18A to FIG. 18C show the correction process when the count Co1 is "4" and Co2 is "0", i.e., when the print position adjust values AV1-AV4 for the forward scan are all odd (O) and the print position adjust values AV9-AV12 for the backward scan are all even (E).

In this case, small dot print positions are adjusted by using the print position adjust values AV1-AV4 and AV9-AV12 so that the small dots are printed on the same column positions during the forward and backward scans as shown in FIG. 18A. In the case of the first embodiment, the small nozzles are driven at timings corresponding to the odd-numbered column positions also during the backward scan. Therefore, "1" is added to the print position adjust values AV9-AV12, which are even (E), to change these values into odd values (O), as shown in FIG. 18B. However, in the case of FIG. 18B, the print positions of small dots printed by the nozzles corresponding the print position adjust values AV9-AV12, i.e., print positions of small dots formed by nozzle C(Lo-1), C(Le-1), M(Lo-1) and M(Le-1), are shifted by 1/1200 inch.

To deal with this problem, the second embodiment checks if the count Co1 and Co2 meet the condition A (step S2003). In this detailed example, since the count Co1 (=4) and Co2 (=0) meet the condition A, step S2004 decides the print position adjust values AV9-AV12, which are even (E), to be odd (O) and moves to step S2005 where the correction processing is executed. Thus, in the correction processing, "1" is not added to the print position adjust values AV9-AV12, which were determined as being odd (O). After all, as shown in FIG. 18C, during the backward scan the small nozzles are driven at timings corresponding to the even-numbered column positions and the large nozzles are driven at timings corresponding to the odd-numbered column positions, as opposed to during the forward scan. This operation can eliminate possible print position deviations of small dots which would otherwise occur as in FIG. 18B.

SECOND DETAILED EXAMPLE

Figure 19A:
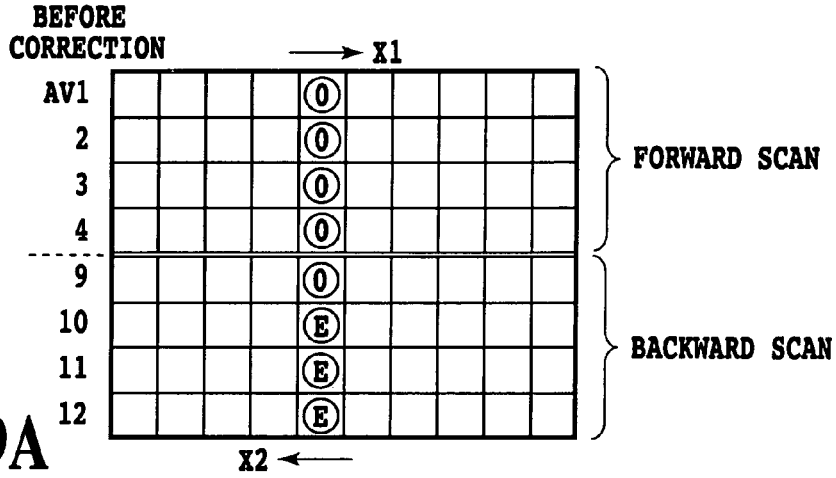
FIG. 19A, FIG. 19B and FIG. 19C are explanatory diagrams showing another example of correction process for the first nozzle group in the second embodiment of the invention.
Figure 19B:
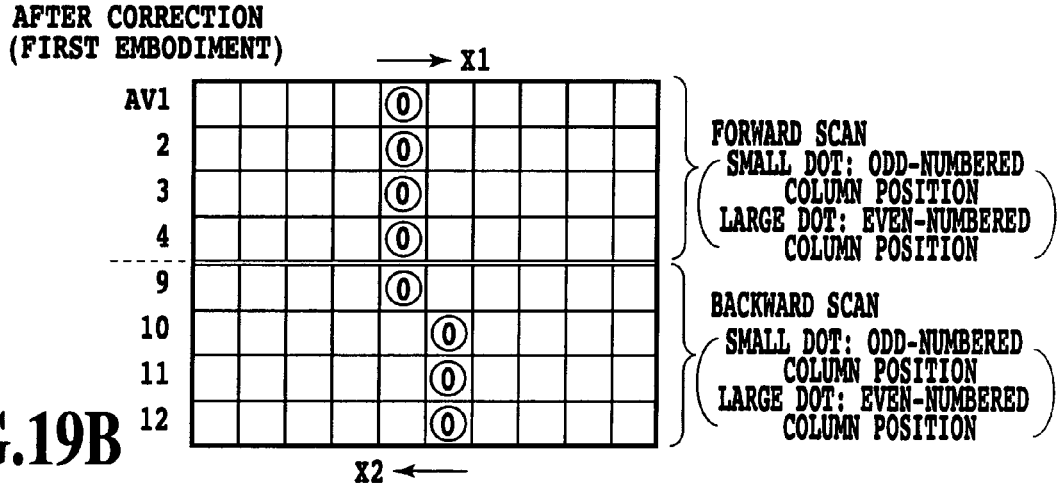
Figure 19C:
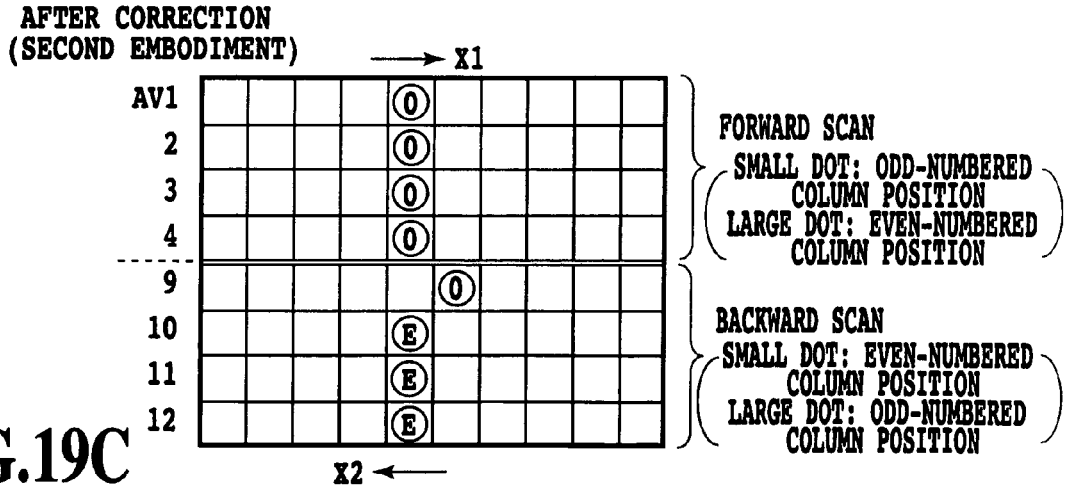

FIG. 19A to FIG. 19C show the correction process when the count Co1 is "4" and Co2 is "1", i.e., when all of the print position adjust values AV1-AV4 for the forward scan are odd (O) and one of the print position adjust values AV9-AV12 for the backward scan is odd (O).

In this case, as described above, small dot print positions are adjusted by using the print position adjust values AV1-AV4 and AV9-AV12 so that the small dots are printed on the same column positions during the forward and backward scans as shown in FIG. 19A. In the case of the first embodiment, the small nozzles are driven at timings corresponding to the odd-numbered column positions also during the backward scan. Therefore, "1" is added to the print position adjust values AV10-AV12, where are even (E), to change these values into odd values (O), as shown in FIG. 19B. However, in the case of FIG. 19B, the print positions of small dots printed by the nozzles corresponding the print position adjust values AV10-AV12, i.e., print positions of small dots formed by nozzle C(Le-1), M(Lo-1) and M(Le-1), are shifted by 1/1200 inch.

To deal with this problem, the second embodiment checks if the count Co1 and Co2 meet the condition A (step S2003). In this detailed example, since the count Co1 (=4) and Co2 (=1) meet the condition A, step S2004 decides the print position adjust values AV10-AV12, which are even (E), to be odd (O) and the print position adjust value AV9, which is odd (O), to be even (E) before moving to step S2005 where the correction processing is executed. Thus, in the correction processing, "1" is not added to the print position adjust values AV10-AV12, which were decided to be odd (O), but is added to the print position adjust value AV9, which was determined to be even (E). After all, as shown in FIG. 19C, during the backward scan the small nozzles are driven at timings corresponding to the even-numbered column positions and the large nozzles are driven at timings corresponding to the odd-numbered column positions, as opposed to during the forward scan. This operation can eliminate print position deviations of small dots printed by nozzles corresponding to the print position adjust values AV10-AV12 in FIG. 19A. When compared with FIG. 19B, although the print positions of small dots printed by the nozzle corresponding to one print position adjust value AV9 are deviated, this operation can reduce the number of deviated small dots.

As described above, this embodiment compares the print position correction values of the first nozzle group for the forward scan and the backward scan and, according to the comparison result, sets the drive timings of the first and second nozzle group for the backward scan. This prevents possible print position deviations and allows high-quality images to be formed by a reciprocal or bidirectional printing.

Other Embodiments

In the above embodiments, we have explained about the print position adjustment between large and small nozzles used, capable of printing different sizes of dots. This invention can also be applied to the print position adjustment between print heads using inks with different densities. In that case, replacing the small nozzles with light ink ejection nozzles and the large nozzles with dark ink ejection nozzles allows the similar processing to the above embodiments to be performed.

To free the user from any additional burden, the printed result of print position adjust patterns may be automatically read by a scanner and, based on the information read in, the print position adjust values may be determined.

With this invention it is preferred that the ink jet printing system use a means for generating a thermal energy to eject ink (for instance, electrothermal transducers, laser beam, etc.). This system is designed to cause a state change in ink by thermal energy and thereby achieve a higher resolution and a wider grayscale range of printed images.

A typical construction and working principle of this system are disclosed in, for instance, U.S. Pat. Nos. 4,723,129 and 4,740,796 and it is desired that the system use such a basic working principle as disclosed in these patent specifications. This system can be applied to both the so-called on-demand type and continuous type but more effectively applied to the on-demand type. In the case of the on-demand type, an electrothermal transducer (heater) arranged to face a sheet or liquid (ink) path holding a liquid (ink) is applied with at least one drive signal that corresponds to print data and which causes a rapid temperature rise in excess of a film boiling. This causes the electrothermal transducer to generate enough thermal energy to produce a film boiling on the heat application surface of a print head, thereby forming a bubble in ink that matches the drive signal in a one-to-one relationship.

In addition, printing apparatus applying the present invention may be constructed in a variety of configurations. For example, the printing apparatus may be provided as an image output terminal of information processing devices, such as computers, and constructed either integral with or separate from these devices. The printing apparatus may also be used in a copying machine in combination with a reader and in a facsimile having a transmission/reception function.

Further, this invention can also be applied to a system comprising a plurality of devices (e.g., host computers, interface devices, readers, printers, etc.) and to single devices (e.g., copying machines and facsimiles). In addition to the ink jet printing apparatus, this invention can also be implemented in the form of a print position setting method for ink jet printing apparatus, a computer program for causing a computer to execute the print position setting method, and a storage medium for storing the computer program.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications.

This application claims priority from Japanese Patent Application No. 2004-238866 filed Aug. 18, 2004, which is hereby incorporated by reference herein.

What is claimed is:

1. An ink jet printing apparatus for printing an image on a print medium by using a print head having a first nozzle group including a plurality of first nozzle lines capable of ejecting ink and a second nozzle group including a plurality of second nozzle lines capable of ejecting ink, wherein the image is formed in a first drive mode and a second drive mode, the first drive mode driving only one of the first and second nozzle groups during one scan of the print head, the second drive mode driving the first and second nozzle groups at different timings during one scan of the print head, the ink jet printing apparatus comprising:

adjust value retrieving means for retrieving a first drive mode adjust value, the first drive mode adjust value being used to adjust a relative print position between the first nozzle lines in the first drive mode; and adjust value setting means for setting a second drive mode adjust value based on the first drive mode adjust value, the second drive mode adjust value being used to adjust a relative print position between the first nozzle lines and between the second nozzle lines in the second drive mode, wherein in the second drive mode, the first nozzle group is driven at one of odd-numbered column positions and even-numbered column positions and the second nozzle group is driven at the other column positions, the second drive mode adjust value includes a correction value corresponding to a position deviation between landing positions of inks ejected from the first and second nozzle groups positioned at the same column position, the correction value being set by said adjust value setting means based on the first drive mode adjust value, and said adjust value setting means corrects the correction value depending on whether the correction value is odd or even so that the first nozzle group is driven at one of odd-numbered column positions and even-numbered column positions and the second nozzle group is driven at the other column positions in the second drive mode.

2. An ink jet printing apparatus according to claim 1, further comprising pattern printing means to print, by using the first nozzle group, print position adjust patterns that can be used for retrieving the first drive mode adjust value.

3. An ink jet printing apparatus according to claim 2, wherein said pattern printing means uses at least one of a first nozzle line for a cyan ink and a first nozzle line for a magenta ink in order to print the print position adjust patterns.

4. An ink jet printing apparatus according to claim 1, wherein the first nozzle group and the second nozzle group differ in a size of dots formed on the print medium.

5. An ink jet printing apparatus according to claim 4, wherein the dots formed by the first nozzle group are smaller than the dots formed by the second nozzle group.

6. An ink jet printing apparatus according to claim 1, wherein the first nozzle group and the second nozzle group eject ink of different densities.

7. An ink jet printing apparatus according to claim 6, wherein the density of ink ejected from the first nozzle group is lighter than the density of ink ejected from the second nozzle group.

8. An ink jet printing apparatus according to claim 1, wherein one of the first nozzle lines and one of the second nozzle lines are situated on the same nozzle line, and on the same nozzle line, first nozzles forming the one of the first nozzle lines and second nozzles forming the one of the second nozzle lines are arranged alternately.

9. An ink jet printing apparatus according to claim 1, wherein the first nozzle lines and the second nozzle lines are situated on different nozzle lines.

10. An ink jet printing apparatus according to claim 1, wherein said adjust value retrieving means retrieves, as the first drive mode adjust value, a first drive mode adjust value for a forward scan that is used when forward scanning the print head in the first drive mode and a first drive mode adjust value for a backward scan that is used when backward scanning the print head in the first drive mode, wherein the second drive mode prints an image by forward and backward scanning the print head and determines a combination of odd- and even-numbered column positions and drive timings of first and second nozzle groups for the forward or backward scan, based on a result of comparison between the first drive mode adjust value for the forward scan and the first drive mode adjust value for the backward scan.

11. An ink jet printing apparatus according to claim 1, wherein said adjust value setting means further includes correction means to correct the second drive mode adjust value according to a difference in ink droplet ejection characteristic between the first nozzle lines and the second nozzle lines.

* * * * *

UNITED STATES PATENT AND TRADEMARK OFFICE

CERTIFICATE OF CORRECTION

PATENT NO. : 7,296,877 B2
APPLICATION NO. : 11/202094
DATED : November 20, 2007
INVENTOR(S) : Chikuma et al.

It is certified that error appears in the above-identified patent and that said Letters Patent is hereby corrected as shown below:

ON THE TITLE PAGE:
At Item (56), References Cited, Primary Examiner, “Matthew Lulu” should read --Matthew Luu--.

COLUMN 3:
Line 27, “there of” should read --thereof--.

COLUMN 4:
Line 33, “include” should read --includes--.

COLUMN 5:
Line 54, “computer” should read --a computer,--.

COLUMN 6:
Line 59, “election” should read --ejection--.
Line 61, “even-numbered” should read --the even-numbered--.

COLUMN 7:
Line 8, “odd-numbered” should read --the odd-numbered--.
Line 11, “odd-numbered” should read --the odd-numbered--.
Line 14, “even-numbered” should read --the even-numbered--.
Line 16, “even-numbered” should read --the even-numbered--.
Line 23, “Co.” should read --C2.--.
Line 33, “odd numbered” should read --odd-numbered--.

COLUMN 8:
Line 4, “nozzle limes” should read --nozzle lines--.

COLUMN 9:
Line 30, “allows” should read --allow--.

COLUMN 13:
Line 47, “(0) and” should read --(O) and--.

UNITED STATES PATENT AND TRADEMARK OFFICE

CERTIFICATE OF CORRECTION

PATENT NO. : 7,296,877 B2
APPLICATION NO. : 11/202094
DATED : November 20, 2007
INVENTOR(S) : Chikuma et al.

It is certified that error appears in the above-identified patent and that said Letters Patent is hereby corrected as shown below:

COLUMN 14:
Line 16, “eject” should read --to eject--.
Line 55, “eject” should read --to eject--.
Line 66, “an post-” should read --a post- --.

COLUMN 17:
Line 5, “corresponding” should read --corresponding to--.
Line 39, “where are” should read --which are--.
Line 42, “corresponding” should read --corresponding to--.
Line 47, “meet” should read --meets--.
Line 49, “meet” should read --meets--.

Signed and Sealed this

Third Day of March, 2009

JOHN DOLL
*Acting Director of the United States Patent and Trademark Office*